US005769801A

United States Patent [19]

Tumey et al.

[11] Patent Number: 5,769,801

[45] **Date of Patent: *Jun. 23, 1998**

[54] MEDICAL PUMPING APPARATUS

[75] Inventors: David Malcolm Tumey, Huber Heights; Robert Louis Cartmell, Bellbrook; Timothy James Riazzi, Kettering; David Bryan McQuain, Dayton; Abdou Farid DeBan, Centervillle, all of Ohio

[73] Assignee: NDM Acquisition Corp., Dayton, Ohio

[ * ] Notice: The term of this patent shall not extend beyond the expiration date of Pat. No. 5,443,440.

[21] Appl. No.: 320,137

[22] Filed: Oct. 7, 1994

Related U.S. Application Data

[63] Continuation-in-part of Ser. No. 76,575, Jun. 11, 1993, Pat. No. 5,443,440.

[51] Int. Cl.[6] ..... A61H 9/00

[52] U.S. Cl. ..... 601/152; 601/150; 602/13

[58] Field of Search ..... 601/15, 22, 149, 601/150, 151, 152; 128/DIG. 20; 602/13

[56] References Cited

U.S. PATENT DOCUMENTS

| | | |
|---|---|---|
| 1,492,514 | 4/1924 | Jensen . |
| 1,608,239 | 11/1926 | Rosett . |
| 2,531,074 | 11/1950 | Miller . |

(List continued on next page.)

FOREIGN PATENT DOCUMENTS

| | | | |
|---|---|---|---|
| 39629 | 11/1981 | European Pat. Off. | 601/151 |
| 514204 | 11/1992 | European Pat. Off. | 601/151 |
| 2390156 | 1/1979 | France . | |
| 0039629 | 11/1981 | France . | |
| 2716137 | 7/1978 | Germany . | |
| 3009408 | 9/1981 | Germany . | |
| 632354 | 11/1978 | Russian Federation . | |
| 233387 | 5/1926 | United Kingdom . | |
| 473639 | 10/1937 | United Kingdom . | |
| 479261 | 2/1938 | United Kingdom . | |
| 490341 | 8/1938 | United Kingdom . | |
| 754883 | 8/1956 | United Kingdom . | |
| 2050174 | 1/1981 | United Kingdom . | |
| 2055580 | 3/1981 | United Kingdom . | |
| 2077108 | 12/1981 | United Kingdom . | |
| 2103489 | 2/1983 | United Kingdom . | |
| 2141938 | 1/1985 | United Kingdom . | |
| 2148720 | 6/1985 | United Kingdom . | |
| 813352 | 5/1989 | United Kingdom . | |
| 8906521 | 7/1989 | WIPO | 128/DIG. 20 |
| 8911845 | 12/1989 | WIPO . | |
| 9103979 | 4/1991 | WIPO . | |

OTHER PUBLICATIONS

MacEachern et al., "The Venous Foot Pump," Paper presented at the British Orthopedic Assoc., Autumn Meeting, Sep. 18–20, 1985.

Gardner et al., "Reduction of Post–Traumatic Swelling and Compartment Pressure by Impulse Compression of the Foot," *The Journal of Bone & Joint Surgery*, vol. 72B, No. 5, Sep. 1990, pp. 810–815.

(List continued on next page.)

*Primary Examiner*—Jeanne M. Clark

*Attorney, Agent, or Firm*—Killworth, Gottman, Hagan & Schaeff, L.L.P.

[57] ABSTRACT

A medical device is provided for applying compressive pressures against a patient's foot. The device comprises first and second panels of flexible material secured to one another to form an inflatable bag to be fitted upon the foot. The bag has first and second separate fluid bladders. The first fluid bladder is adapted to engage a first portion of the foot and the second fluid bladder is adapted to engage a second portion of the foot. A boot is provided for holding the inflatable bag to the foot. A fluid supply is provided for applying pressurized fluid to the first and second fluid bladders such that the first fluid bladder applies a first compressive pressure upon the first portion of the foot and the second fluid bladder applies a second compressive pressure upon the second portion of the foot. A safety vent is associated with one of the inflatable bag and the fluid supply.

12 Claims, 14 Drawing Sheets

U.S. PATENT DOCUMENTS

| | | | |
|---|---|---|---|
| 2,638,090 | 5/1953 | Nantz . | |
| 2,694,395 | 11/1954 | Brown . | |
| 2,781,041 | 2/1957 | Weinberg . | |
| 2,880,721 | 4/1959 | Corcoran . | |
| 2,893,382 | 7/1959 | Demeny . | |
| 3,171,410 | 3/1965 | Towle, Jr. et al. . | |
| 3,403,673 | 10/1968 | MacLeod . | |
| 3,525,333 | 8/1970 | Mencacci . | |
| 3,774,598 | 11/1973 | Wilson et al. . | |
| 3,811,431 | 5/1974 | Apstein . | |
| 3,824,992 | 7/1974 | Nicholson et al. . | |
| 3,826,249 | 7/1974 | Lee et al. . | |
| 3,835,845 | 9/1974 | Maher . | |
| 3,859,989 | 1/1975 | Spielberg . | |
| 3,865,102 | 2/1975 | Birtwell et al. . | |
| 3,865,103 | 2/1975 | Folman . | |
| 3,866,604 | 2/1975 | Curless et al. . | |
| 3,888,242 | 6/1975 | Harris et al. . | |
| 3,892,229 | 7/1975 | Taylor et al. . | |
| 3,908,642 | 9/1975 | Vinmont . | |
| 3,920,006 | 11/1975 | Lapidus . | |
| 3,942,518 | 3/1976 | Tenteris et al. . | |
| 3,976,056 | 8/1976 | Brawn . | |
| 3,982,531 | 9/1976 | Shaffer . | |
| 3,993,053 | 11/1976 | Grossan . | |
| 4,029,087 | 6/1977 | Dye et al. . | |
| 4,030,488 | 6/1977 | Hasty . | |
| 4,044,759 | 8/1977 | Ghaysuran . | |
| 4,054,129 | 10/1977 | Byars et al. . | |
| 4,077,402 | 3/1978 | Benjamin, Jr. et al. . | |
| 4,091,804 | 5/1978 | Hasty . | |
| 4,153,050 | 5/1979 | Bishop et al. . | |
| 4,186,732 | 2/1980 | Christoffel . | |
| 4,198,961 | 4/1980 | Arkans . | |
| 4,202,325 | 5/1980 | Villari et al. . | |
| 4,206,751 | 6/1980 | Schneider . | |
| 4,207,876 | 6/1980 | Annis . | |
| 4,231,355 | 11/1980 | Hara . | |
| 4,269,175 | 5/1981 | Dillon . | |
| 4,270,527 | 6/1981 | Peters et al. . | |
| 4,311,135 | 1/1982 | Brueckner et al. . | |
| 4,370,975 | 2/1983 | Wright . | |
| 4,372,297 | 2/1983 | Perlin . | |
| 4,374,518 | 2/1983 | Villanueva . | |
| 4,402,312 | 9/1983 | Villari et al. . | |
| 4,408,599 | 10/1983 | Mummert . | |
| 4,418,690 | 12/1983 | Mummert . | |
| 4,453,538 | 6/1984 | Whitney . | |
| 4,461,301 | 7/1984 | Ochs . | |
| 4,494,550 | 1/1985 | Blazek et al. . | |
| 4,502,470 | 3/1985 | Kiser et al. . | |
| 4,519,395 | 5/1985 | Hrushesky . | |
| 4,552,133 | 11/1985 | Kawaguchi | 601/149 |
| 4,574,812 | 3/1986 | Arkans . | |
| 4,577,626 | 3/1986 | Marukawa et al. . | |
| 4,614,179 | 9/1986 | Gardner et al. . | |
| 4,614,180 | 9/1986 | Gardner et al. . | |
| 4,624,244 | 11/1986 | Taberi . | |
| 4,696,289 | 9/1987 | Gardner et al. . | |
| 4,702,232 | 10/1987 | Gardner et al. . | |
| 4,721,101 | 1/1988 | Gardner et al. . | |
| 4,753,226 | 6/1988 | Zheng et al. . | |
| 4,773,397 | 9/1988 | Wright et al. | 601/151 |
| 4,809,684 | 3/1989 | Gardner et al. . | |
| 4,841,956 | 6/1989 | Gardner et al. . | |
| 4,846,160 | 7/1989 | Gardner et al. . | |
| 4,858,147 | 8/1989 | Conwell . | |
| 4,945,905 | 8/1990 | Dye et al. . | |
| 4,974,597 | 12/1990 | Walloch . | |
| 4,993,420 | 2/1991 | Welkavitz et al. . | |
| 5,014,714 | 5/1991 | Millay et al. . | |
| 5,025,781 | 6/1991 | Ferrari | 601/151 |
| 5,060,279 | 10/1991 | Crawford et al. . | |
| 5,090,417 | 2/1992 | Mollan et al. . | |
| 5,099,851 | 3/1992 | Hata et al. . | |
| 5,121,745 | 6/1992 | Israel . | |
| 5,126,967 | 6/1992 | Simko . | |
| 5,157,733 | 10/1992 | Takeo et al. . | |
| 5,207,214 | 5/1993 | Romano . | |
| 5,288,286 | 2/1994 | Davis et al. | 602/13 |

OTHER PUBLICATIONS

Gardner et al., "The Venous Pump of the Human Foot–Preliminary Report," Bristol Medico–Chisurgical Journal, Jul. 1983.

Brochure, "The AV–1000™–A Remarkable New Non–Ivasive Diagnostic Tool that Belongs in Every Physician's Office," Hermodynamics, Inc.

Blazek et al., "Functional Diagnostic of Peripheral Vehin Disorders," Oct. 1984, pp. 4–7.

Weinert, Photoplethyemography (PPG) and Light Reflection Rheography (LRR), pp. 31–33.

Hubner, "Is the Light Reflection Rheography (LRR) Suitable as a Diagnostic Method for the Phlebology Practice?" *Phlebology and Proctology*, 1986; 15, pp. 209–212.

Correlation of Venous Pressure Measurements with Light Reflection Rheography (LRR), Hemodynamics Incorporated.

Stubbs, "Neurocomputers," pp. 1–12.

McCarthy et al., "A New Method of Preventing the Fatal Embolus," *Surgery*, vol. 25, No. 6, Jun. 1949, pp. 891–896.

Brochure, Flowtron Air, Ventilated Compression System, Huntleight Technology, England and Aberdeen, New Jersey.

Brochure, "Hemaflo–Intermittent Compression," Medipedic, Jackson, Michigan.

MEDICAL PUMPING APPARATUS

CROSS-REFERENCE TO RELATED APPLICATION

This application is a continuation-in-part of applicants' earlier filed application Ser. No. 08/076,575, filed Jun. 11, 1993, now U.S. Pat. No. 5,443,440, issued Aug. 22, 1995.

BACKGROUND OF THE INVENTION

The present invention relates generally to medical pumping apparatus and, more particularly, to such an apparatus having an inflatable bag with first and second separate fluid bladders which apply distinct compressive pressures to separate portions of a patient's foot.

Medical pumping apparatus have been employed in the prior art to increase or stimulate blood flow in a limb extremity, such as a hand or a foot. For example, in U.S. Pat. No. 4,614,179, a pumping device is disclosed having an inflatable bag provided with a single bladder adapted to engage between plantar limits of the ball and heel of a foot to flatten the plantar arch and stimulate venous blood flow. Various embodiments of the inflatable bag are disclosed. Each embodiment, however, is provided with only a single bladder which engages only a limited portion of the foot.

It is believed that optimum venous blood flow in a foot is achieved when an inflatable bag is used that engages and applies pressure to a substantial portion of the foot. Oftentimes, however, an inflatable bag that encases a substantial portion of the foot and is inflated to a pressure level required to effect venous blood flow is found by the patient to be too uncomfortable.

The noted patent discloses a pump which communicates with the bag for cyclically inflating and deflating the bag. The pump, however, is not capable of recording patient compliance data (e.g, time, date and duration of each use by the patient) for subsequent downloading to a computer in a physician's office. Nor is it capable of having operating parameters input either manually or via a physician's computer.

The pumping device in the referenced patent also fails to include means for allowing a physician to run a prescreening test prior to prescribing use of the device to a patient to ensure that the patient does not have a venous blood flow problem, such as deep vein thrombosis (DVT). The pumping device further lacks means for predicting for each individual patient an appropriate time period for deflation or vent cycles.

Accordingly, there is a need for an improved medical pumping apparatus having an inflatable bag which engages a substantial portion of a patient's foot and achieves optimum blood flow at an acceptable patient comfort level. It is desirable that the apparatus include a fluid generator having a controller which is capable of creating and storing patient compliance data for subsequent transmission to a physician's computer. It is also desirable that the generator include a controller that is capable of storing operating parameters set manually via a manual selector or generated via a physician's computer. It would further be desirable to have a medical pumping apparatus which includes means for allowing a physician to run a prescreening test prior to prescribing use of the device to a patient to ensure that the patient does not have a venous blood flow problem. It would additionally be desirable to have a medical pumping apparatus provided with means for predicting for each individual patient an appropriate time period for deflation cycles.

SUMMARY OF THE INVENTION

These needs are met by the present invention, wherein an improved medical pumping apparatus is provided which includes an inflatable bag having first and second bladders for applying distinct compressive pressures to separate portions of a foot. The second bladder, which engages the heel, a forward portion of the sole and the dorsal aspect of the foot and is filled with fluid at a lower rate than that of the first bladder, compensates for reduced swelling which occurs during use. Further provided is a fluid generator for cyclically inflating and deflating the bag. The fluid generator is provided with a controller that is capable of storing operating parameters set manually via a manual selector or generated by way of a physician's computer. In the latter instance, the manual selector may be partially or completely disabled to prevent subsequent manual input of one or more different operating parameters by the patient. The fluid generator controller is also capable of producing and saving patient compliance data for subsequent transmission to a physician's computer. The apparatus further includes means for allowing a physician to run a prescreening test prior to prescribing use of the device to a patient to ensure that the patient does not have a venous blood flow problem, such as deep vein thrombosis. It also includes means for predicting for each individual patient an appropriate time period for deflation cycles.

In accordance with a first aspect of the present invention, a medical device is provided for applying compressive pressures against a patient's foot. The device comprises first and second panels of flexible material secured to one another to form an inflatable bag to be fitted upon the foot. The bag has first and second separate fluid bladders. The first fluid bladder is adapted to engage a first portion of the foot and the second fluid bladder is adapted to engage a second portion of the foot. Securing means is provided for holding the inflatable bag to the foot. Fluid supply means is provided for applying pressurized fluid to the first and second fluid bladders such that the first fluid bladder applies a first compressive pressure upon the first portion of the foot and the second fluid bladder applies a second compressive pressure upon the second portion of the foot.

The fluid supply means comprises generator means for cyclically generating fluid pulses during periodic inflation cycles. It also serves to vent fluid from the first and second bladders to atmosphere during periodic vent cycles between the inflation cycles. The fluid supply means further includes fluid conducting means connected to the first and second bladders and the generator means for communicating the fluid pulses generated by the generator means to the first and second bladders.

The generator means comprises controller means for storing an operating pressure value for the fluid pulses and an operating time period for the periodic vent cycles. It also comprises manual selector means for setting a preferred pressure value to be stored by the controller means as the operating pressure value and a preferred time period to be stored by the controller means as the operating time value.

The supply means may also include processor means associated with the generator means for generating a preferred pressure value for the fluid pulses and a preferred time period for the vent cycles. The processor means is coupled to the generator means for transmitting the preferred pressure value and the preferred time period to the controller means of the generator means to be stored by the controller means as the operating pressure value and the operating time period and disabling partially or completely the manual selector means whenever a preferred pressure value and a preferred time period are stored by the controller means in response to receiving same from the processor means. It is further contemplated by the present invention that processor means may be provided alone without manual selector means, or manual selector means may be provided alone without processor means.

The controller of the generator means further provides for producing and saving patient compliance data and for transmitting the patient compliance data to the processor means.

The operating pressure value for the fluid pulses is selected from a range of 3 to 7 psi. The operating pressure value is set at the value which elicits the most efficacious physiological response from the patient. The duration of each of the inflation cycles is approximately 3 seconds.

The fluid conducting means comprises a first tubular line connected at its distal end to the first bladder, a second tubular line connected at its distal end to the second bladder, a third tubular line connected at its distal end to a proximal end of the first tubular line, a fourth tubular line connected at its distal end to a proximal end of the second tubular line, and a fifth tubular line connected at its distal end to proximal ends of the third and fourth tubular lines. The fourth tubular line is provided with a restrictive orifice for preventing delivery of fluid into the second bladder at the same rate at which fluid is delivered into the first bladder.

The first portion of the foot comprises the plantar arch and the second portion of the foot includes the heel, a forward portion of the sole and the dorsal aspect of the foot.

The first and second panels of flexible material may be formed from polyurethane or polyvinyl chloride.

The securing means may comprise a boot which receives the bag and includes first and second tabs adapted to connect with one another after the boot and the bag are fitted upon a foot to hold the boot and the bag to the foot.

The medical device may further include means for allowing a physician to run a prescreening test prior to prescribing use of the device to a patient to ensure that the patient does not have a venous blood flow problem, such as deep vein thrombosis. It may also include means for predicting for each individual patient an appropriate time period for vent cycles.

In accordance with a second aspect of the present invention, a medical device is provided for applying compressive pressures against a patient's foot. The device comprises first and second panels of flexible material secured to one another to form an inflatable bag to be fitted upon the foot, a fluid supply and a safety vent port. The inflatable bag has first and second separate fluid bladders. The first fluid bladder is adapted to engage a first portion of the foot and the second fluid bladder is adapted to engage a second portion of the foot. The fluid supply applies pressurized fluid to the first and second fluid bladders such that the first fluid bladder applies a first compressive pressure upon the first portion of the foot and the second fluid bladder applies a second compressive pressure upon the second portion of the foot. The fluid supply comprises a generator for cyclically generating fluid pulses during periodic inflation cycles, and a fluid conductor connected to the first and second bladders and the generator for communicating the fluid pulses generated by the generator to the first and second bladders. The safety vent port is associated with one of the first and second panels and the fluid conductor to vent pressurized fluid to atmosphere.

In accordance with one embodiment of the present invention, the fluid conductor comprises a first tubular line connected at its distal end to the first bladder, a second tubular line connected at its distal end to the second bladder, a Y-connector connected at its first distal end to a proximal end of the first tubular line and at its second distal end to a proximal end of the second tubular line, and a third tubular line connected at its distal end to a proximal end of the Y-connector. The Y-connector of the fluid conductor includes the safety vent port. Preferably, the Y-connector further includes a restrictive orifice for preventing delivery of fluid into the second bladder at the same rate at which fluid is delivered into the first bladder.

In accordance with another embodiment of the present invention, the fluid conductor is essentially the same as the fluid conductor of the first embodiment, except that the second tubular line includes the safety vent port. In accordance with a further embodiment of the present invention, the safety vent port is associated with one of the first and second panels.

In accordance with a third aspect of the present invention, an inflatable bag is provided which is adapted to be secured to a patient's foot for applying compressive pressures against the patient's foot upon receiving pressurized fluid from a fluid source. The bag includes first and second panels of flexible material secured to one another to form first and second separate fluid bladders. The first fluid bladder is adapted to engage a first portion of the foot for applying a first compressive pressure thereto and the second fluid bladder is adapted to engage a second portion of the foot for applying a second compressive pressure thereto. A fluid conductor is connected to the first and second bladders and the fluid source to permit the fluid source to supply pressurized fluid to the first and second bladders. A safety vent port is associated with one of the first and second panels and the fluid conductor to vent pressurized fluid to atmosphere.

Accordingly, it is an object of the present invention to provide an improved medical pumping apparatus having an inflatable bag which engages a substantial portion of a patient's foot to achieve optimum blood flow at an acceptable patient comfort level. It is a further object of the present invention to provide a medical pumping apparatus having a fluid generator with a controller which is capable of producing and saving patient compliance data for subsequent transmission to a physician's computer. It is another object of the present invention to provide a medical pumping apparatus having a fluid generator with a controller that is capable of storing operating parameters set manually via a manual selector or generated by way of a physician's computer. It is yet another object of the present invention to provide an apparatus having means for allowing a physician to run a prescreening test prior to prescribing use of a medical pumping device to a patient to ensure that the patient does not have a venous blood flow problem. It is yet a further object of the present invention to provide a medical apparatus having means for predicting for each individual patient an appropriate time period for vent cycles. It is still another object of the present invention to provide a medical apparatus having an inflatable bag provided with a safety vent port.

These and other objects of the present invention will be apparent from the following description, the accompanying drawings and the appended claims.

DETAILED DESCRIPTION OF THE INVENTION

Figure 1:
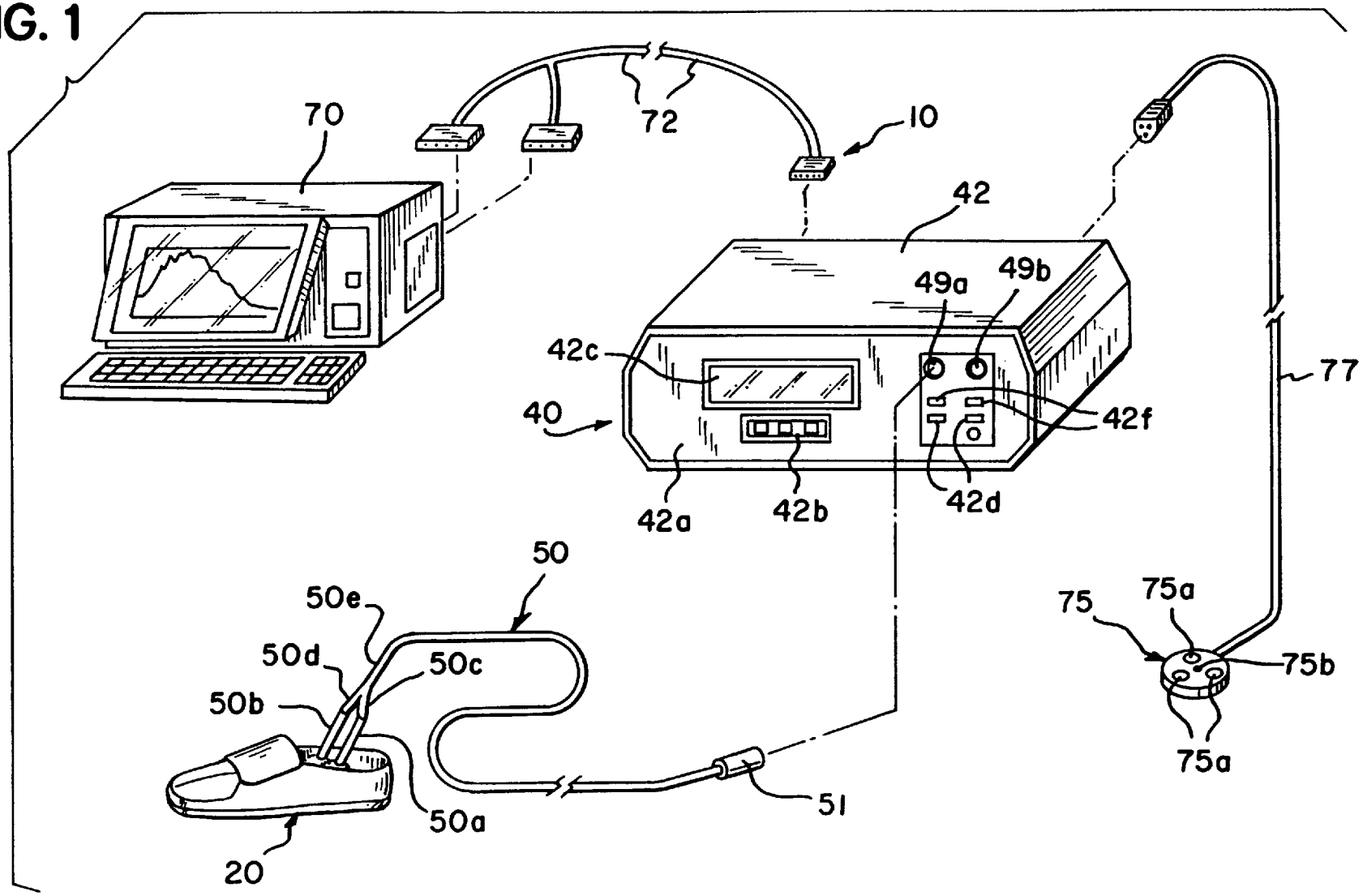
FIG. 1 is a perspective view of medical pumping apparatus constructed and operable in accordance with the present invention.

A medical pumping apparatus 10 constructed and operable in accordance with the present invention is shown in FIG. 1. The apparatus includes a boot 20 adapted to be fitted upon and secured to a patient's foot. The boot 20 is provided with an inflatable bag 30 (see FIGS. 2 and 4) which, when inflated, serves to apply compressive pressures upon the patient's foot to stimulate venous blood flow. The apparatus 10 further includes a fluid generator 40 which cyclically generates fluid pulses, air pulses in the illustrated embodiment, during periodic inflation cycles. The fluid pulses are communicated to the bag 30 via a first conducting line 50. The generator 40 also serves to vent fluid from the bag 30 to atmosphere during periodic vent or deflation cycles between the periodic inflation cycles.

Figure 2:
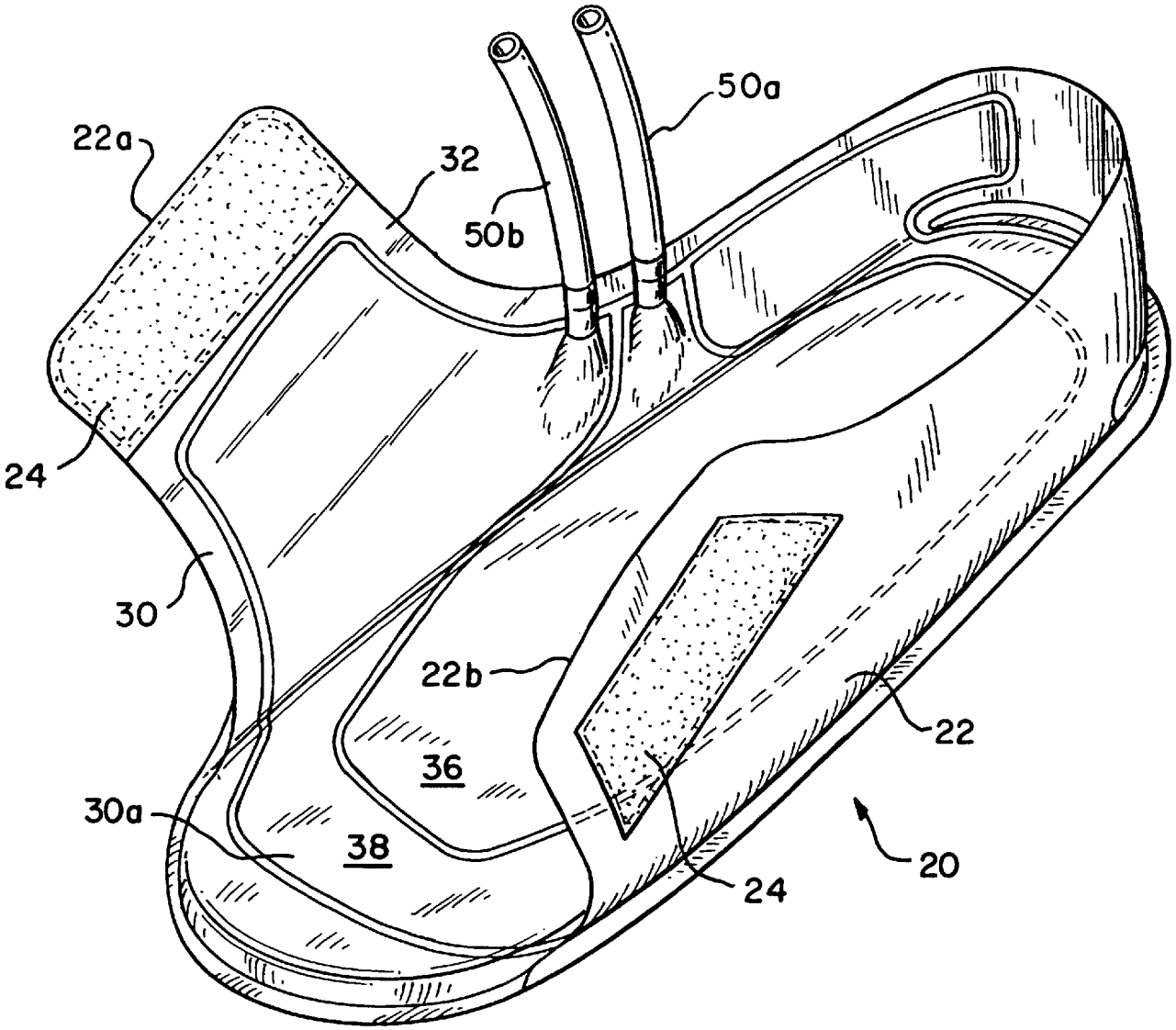
FIG. 2 is a perspective view of the boot and inflatable bag of the present invention.
Figure 3:
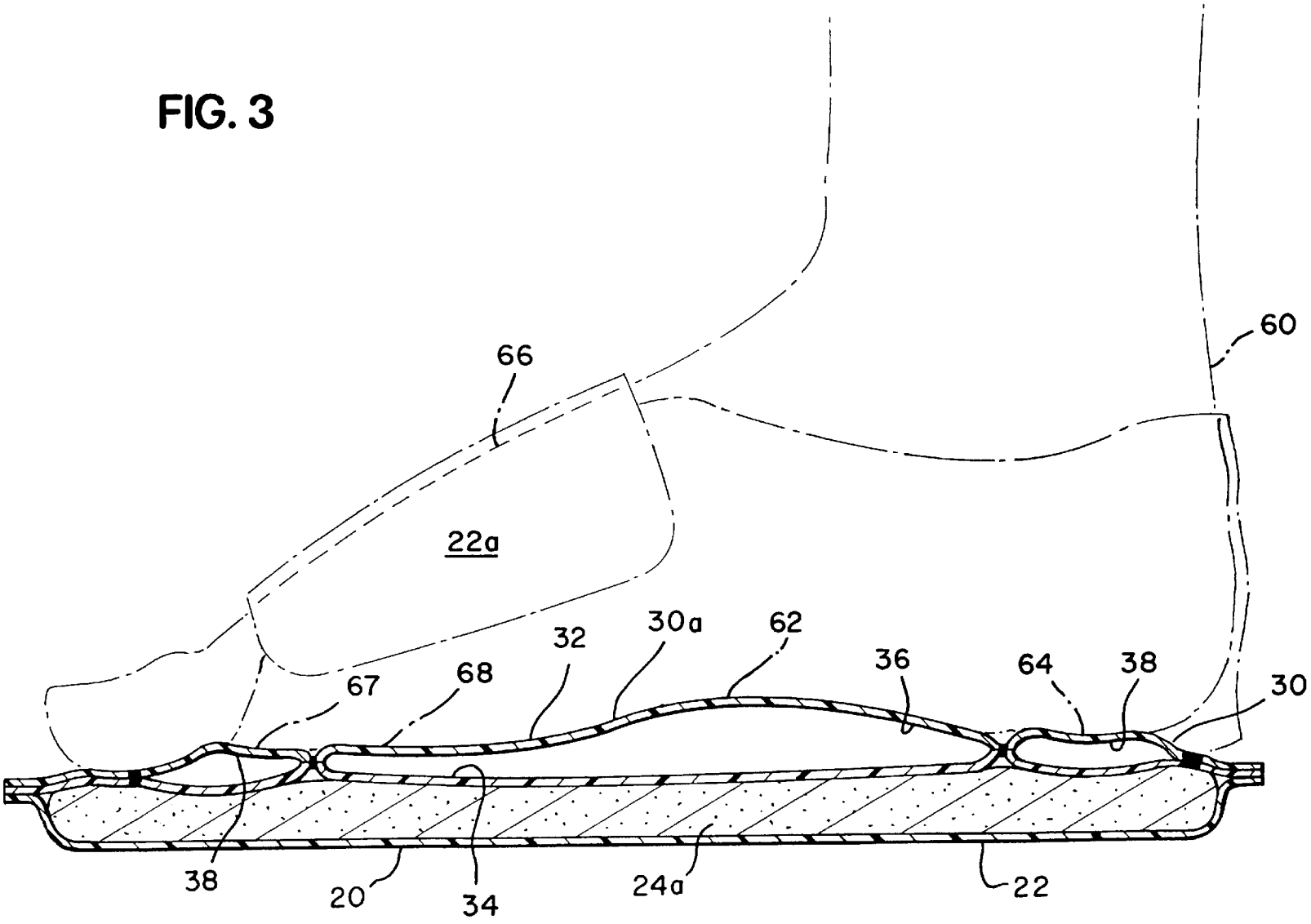
FIG. 3 is a cross-sectional view of the inflatable bag and the lower portion of the boot with the upper portion of the boot and a patient's foot shown in phantom.

Referring to FIGS. 2–5, the inflatable bag 30 is constructed from first and second panels 32 and 34 of flexible material such as polyurethane, polyvinyl chloride or the like. The panels 32 and 34 are heat sealed or otherwise secured to one another to form first and second fluid bladders 36 and 38, respectively. As best shown in FIG. 3, the first fluid bladder 36 engages a patient's foot 60 approximately at the plantar arch 62, which extends between the metatarsal heads and the heel 64. The second fluid bladder engages the foot approximately at the dorsal aspect 66, the heel 64 and a forward portion 67 of the sole 68 of the foot 60 beneath toe phalanges. As should be apparent, the exact foot portions engaged by the two bladders will vary somewhat from patient to patient.

As best shown in FIGS. 2 and 3, the boot 20 comprises a flexible outer shell 22 made from a flexible material, such as vinyl coated nylon. The inflatable bag is placed within the shell 22 and is adhesively bonded, heat sealed or otherwise secured thereto. Interposed between the outer shell 22 and the inflatable bag 30 is a stiff sole member 24*a* formed, for example, from acrylonitrile butadiene styrene. The outer shell 22 is provided with first and second flaps 22*a* and 22*b* which, when fastened together, secure the boot 20 in a fitted position upon a patient's foot. Each of the flaps 22*a* and 22*b* is provided with patches 24 of loop-pile fastening material, such as that commonly sold under the trademark Velcro. The patches 24 of loop-pile material permit the flaps 22*a* and 22*b* to be fastened to one another. A porous sheet of lining material (not shown) comprising, for example, a sheet of polyester nonwoven fabric, may be placed over the upper surface 30*a* of the inflatable bag 30 such that it is interposed between the bag 30 and the sole 68 of the foot when the boot 20 is secured upon the foot 60.

Figure 6:
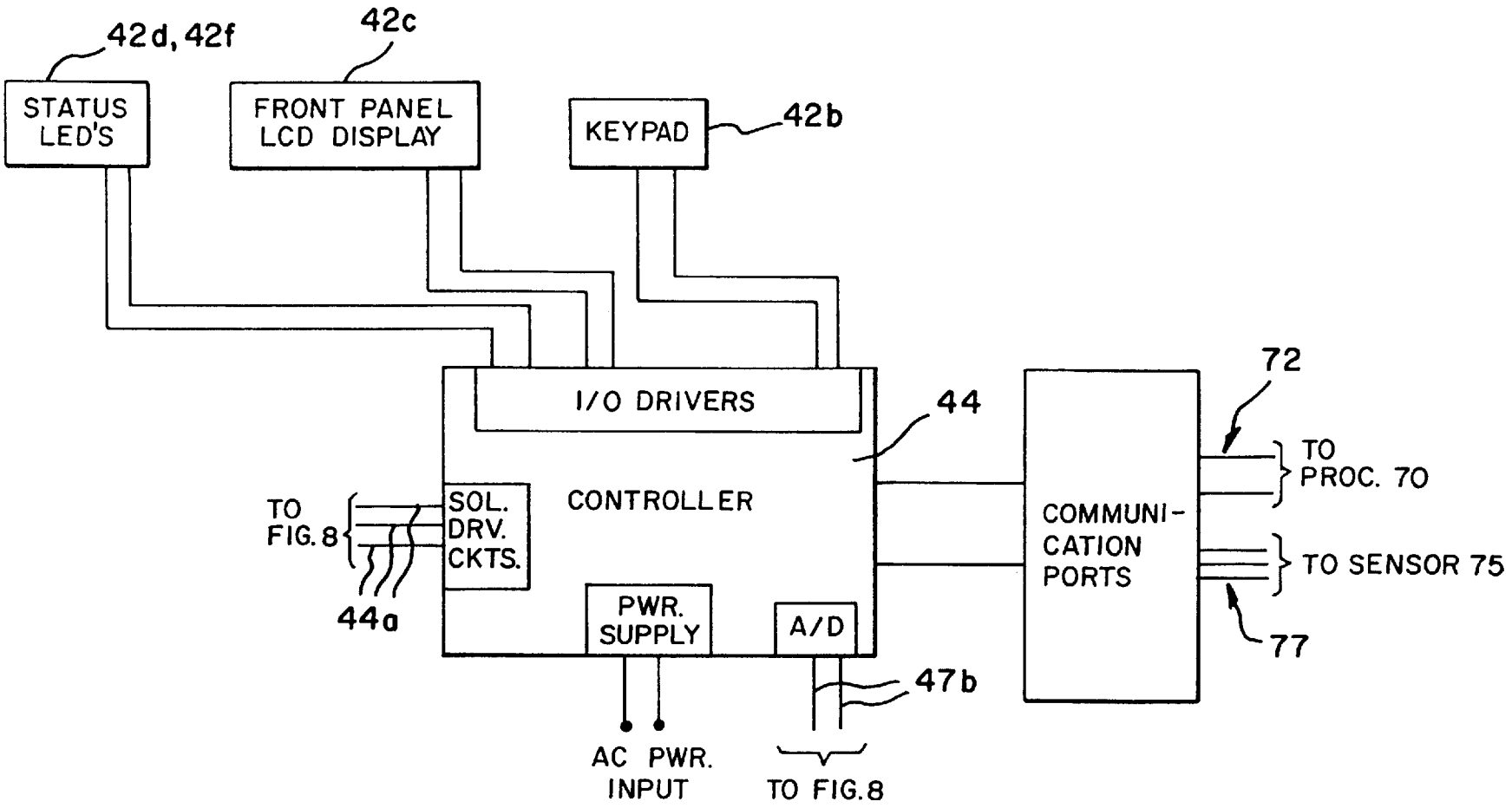
FIG. 6 is a schematic illustration of the controller of the fluid generator illustrated in FIG. 1.

The fluid generator 40 includes an outer case 42 having a front panel 42*a*. Housed within the outer case 42 is a controller 44 which is schematically illustrated in FIG. 6. The controller 44 stores an operating pressure value for the fluid pulses, an operating time period for the periodic inflation cycles and an operating time period for the periodic vent cycles. In the illustrated embodiment, the operating time period for the periodic inflation cycles is fixed at 3 seconds. The other two parameters may be varied.

Figure 7:
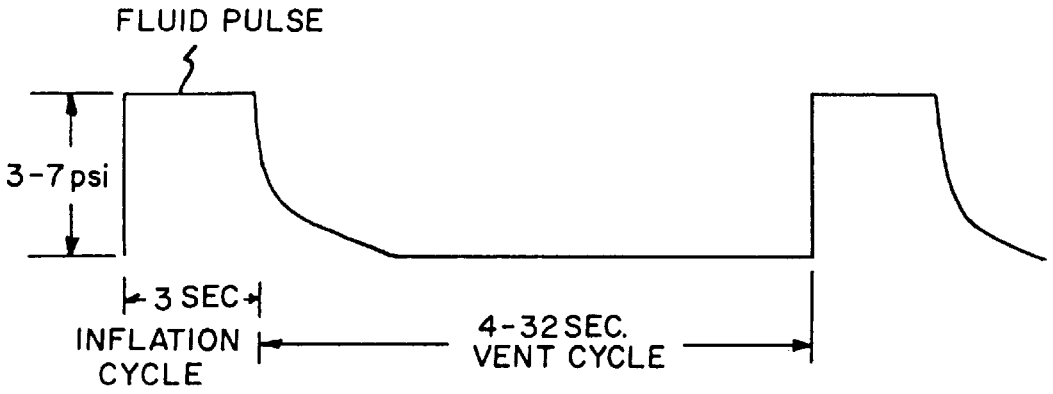
FIG. 7 is a graphical representation of an inflation cycle and vent cycle for an inflatable bag.

The front panel 42*a* of the outer case 42 is provided with a keypad 42*b* for setting a preferred pressure value to be stored by the controller 44 as the operating pressure value. By way of example, the preferred pressure value may be selected from a range varying from 3 to 7 psi. The keypad 42*b* is also capable of setting a preferred time period to be stored by the controller 44 as the operating time period for the periodic vent cycles. For example, the preferred vent cycle time period may be selected from a range varying from 4 to 32 seconds. As an alternative to setting a time period for just the vent cycles, a combined time period, determined by adding the time period for the inflation cycles with the time period for the vent cycles, may be set via the keypad 42*b* for storage by the controller 44. A graphical representation of an inflation cycle followed by a vent cycle for the inflatable bag 30 is shown in FIG. 7.

In the illustrated embodiment, a processor 70 is provided (e.g., at a physician's office) for generating a preferred pressure value for the fluid pulses and a preferred time period for the vent cycles. The processor 70 is coupled to the fluid generator 40 via an interface cable 72 and transmits the preferred pressure value and the preferred time period to the controller 44 for storage by the controller 44 as the operating pressure value and the operating time period. The processor 70 also transmits a disabling signal to the controller 44 to effect either partial or complete disablement of the keypad 42*b*. As a result, the patient is precluded from adjusting the operating pressure value or the operating time period or both via the keypad 42*b*, or is permitted to adjust one or both values, but only within predefined limits. An operator may reactivate the keypad 42*b* for setting new operating parameters (i.e., to switch from the processor input mode to the keypad input mode) by actuating specific keypad buttons in a predefined manner.

The controller 44 further provides for producing and saving patient compliance data (e.g., time, date and duration of each use by the patient), which data can be transmitted by the controller 44 to the processor 70 for storage by same.

Figure 8:
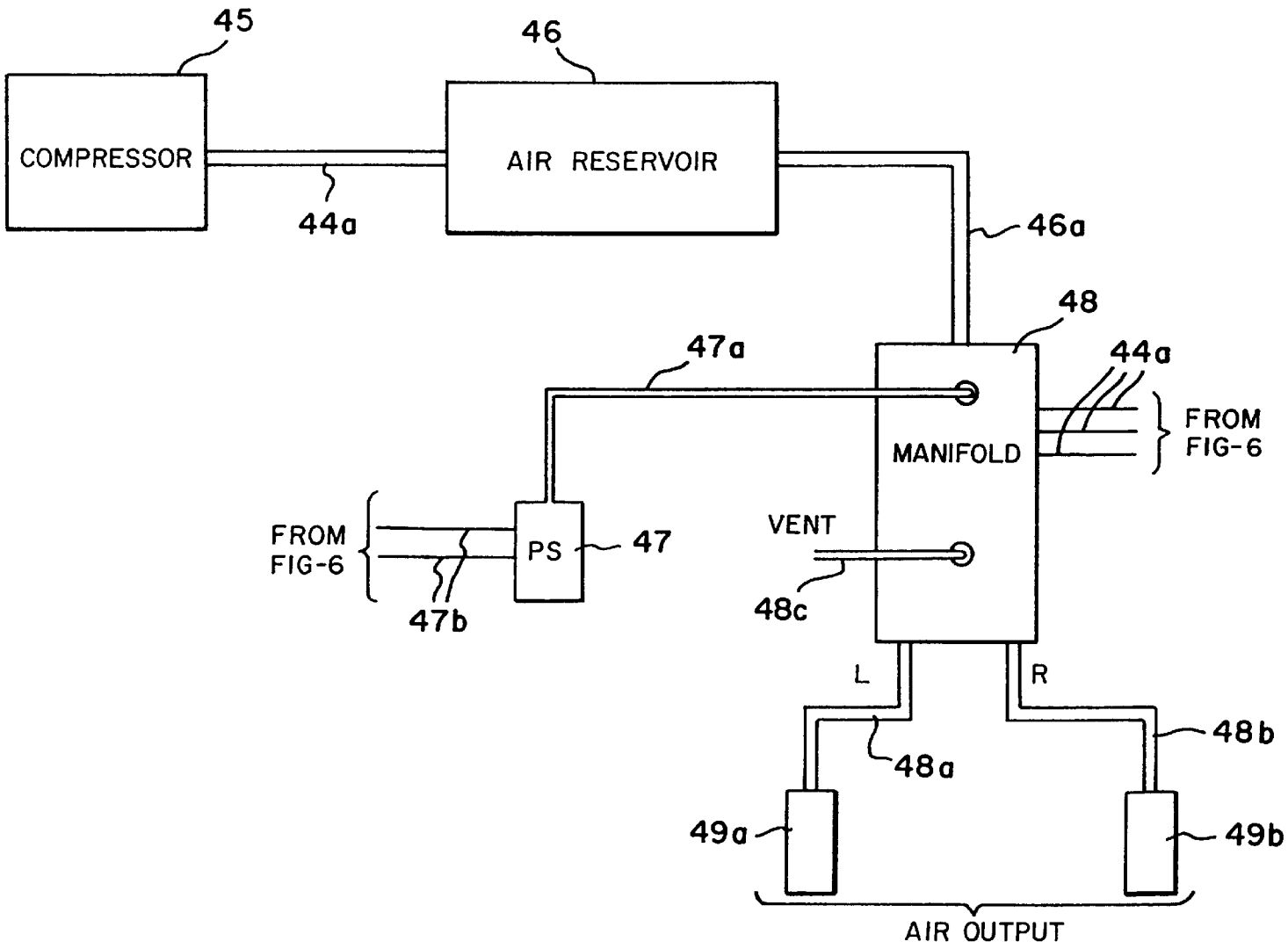
FIG. 8 is a block diagram of the compressor, air reservoir, manifold and pressure sensor of the fluid generator illustrated in FIG. 1.

Further housed within the outer case 42 is an air compressor 45, an air reservoir 46, a pressure sensor 47 and a manifold 48, as shown schematically in FIG. 8. Extending from the manifold 48 are left and right fluid lines 48*a* and 48*b* which terminate at left and right fluid outlet sockets 49*a* and 49*b*. The left fluid socket 49*a* extends through the front panel 42*a* of the outer case 42 for engagement with a mating connector 51 located at the proximal end of the conducting line 50, see FIG. 1. The conducting line 50 is secured at its distal end to the inflatable bag 30. The right socket 49*b* likewise extends through the front panel 42*a* for engagement with a mating connector located at the proximal end of a second conducting line (not shown) which is adapted to be connected at its distal end to a second inflatable bag (not shown).

Compressed air generated by the compressor 45 is supplied to the reservoir 46 for storage via fluid line 44*a*. The reservoir 46 communicates with the manifold 48 via a fluid line 46*a*.

An inflate solenoid, a vent solenoid, a channel solenoid and associated valves are provided within the manifold 48. The inflate solenoid effects the opening and closing of its associated valve to control the flow of fluid into the manifold 48 from the air reservoir 46 via fluid line 46*a*. The vent solenoid effects the opening and closing of its associated valve to control the flow of fluid from the manifold 48 to atmosphere via a vent line 48*c*. The channel solenoid effects the opening and closing of its associated valve to control the flow of fluid from the manifold 48 to fluid line 48*a* or fluid line 48*b*.

Actuation of the solenoids is controlled by the controller 44, which is coupled to the solenoids via conductors 44*a*. During inflation cycles, the controller 44 actuates the vent solenoid to prevent the venting of fluid in the manifold 48 to atmosphere via vent line 48*c*. The controller 44 further actuates the inflate solenoid to allow pressurized air to pass from the air reservoir 46, through the manifold 48 to either the fluid line 48*a* or the fluid line 48*b*.

During vent cycles, the controller 44 initially causes the inflate solenoid to stop pressurized fluid from passing into the manifold 48 from the reservoir 46. It then causes the vent solenoid to open for at least an initial portion of the vent cycle and vent the fluid in the manifold 48 to atmosphere.

Depending upon instructions input via the keypad 42*b* or the processor 70, the controller 44 also serves to control, via the channel solenoid, the flow of fluid to either line 48*a* or line 48*b*. If only a single boot 20 is being employed, the processor 70 does not activate the channel solenoid and line 48*a*, which is normally in communication with the manifold 48, communicates with the manifold 48 while line 48*b* is prevented from communicating with the manifold 48 by the valve associated with the channel solenoid. If two boots 20 are being employed, the controller 44 activates and deactivates the channel solenoid to alternately communicate the lines 48*a* and 48*b* with the manifold 48, thereby simulating walking. As should be apparent, when two boots 20 are used in an alternating manner, each boot will have its own separate inflation and vent cycles. Thus, during the vent cycle for the bag 30, an inflation cycle takes place for the other bag (not shown). The inflate solenoid allows pressurized fluid to pass from the air reservoir 46, through the manifold 48 and into the fluid line 48*b* associated with the other bag, while the channel solenoid has been activated to prevent communication of the fluid line 48*a* associated with the bag 30 with the manifold 48.

The air pressure sensor 47 communicates with the manifold 48 via an air line 47*a* and senses the pressure level within the manifold 48, which corresponds to the pressure level which is applied to either the fluid line 48*a* or the fluid line 48*b*. The pressure sensor 47 transmits pressure signals to the controller 44 via conductors 47*b*. Based upon those pressure signals, the controller 44 controls the operation of the inflate solenoid, such as by pulse width modulation or otherwise. Pulse width modulation for this application comprises activating the inflate solenoid for one pulse per cycle, with the pulse lasting until the desired pressure is achieved. The length of the pulse is based upon an average of the fluid pressure level during previous inflation cycles as measured by the pressure sensor 47. Pulse length and hence pressure level is iteratively adjusted in small steps based on each immediately preceding pulse. In this way, the fluid pressure within the manifold 48, and thereby the pressure which is applied to either fluid line 48*a* or fluid line 48*b*, is maintained substantially at the stored operating pressure value with no sudden changes in pressure level.

In an alternative embodiment, the pressure sensor 47 is replaced by a force sensor (not shown) secured to the bag 30 so as to be interposed between the first bladder 36 and the sole 68 of the foot 60. The force sensor senses the force applied by the bladder 36 to the foot 60 and transmits force signals to the controller 44 which, in response, controls the operation of the inflate solenoid to maintain the fluid pressure within the manifold 48, and thereby the pressure which is applied to either fluid line 48*a* or fluid line 48*b*, at the stored operating pressure level.

Figure 4:
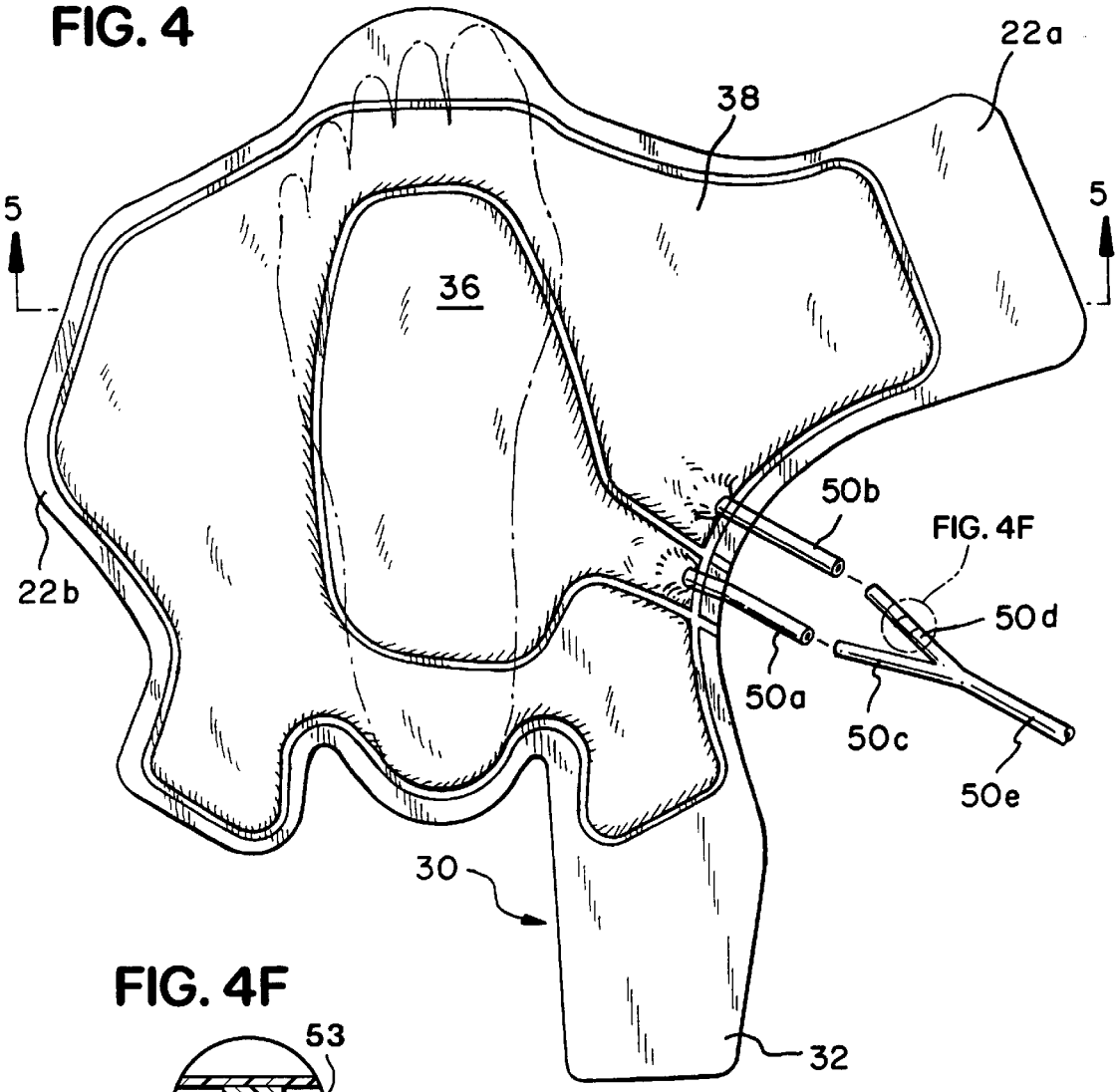
FIG. 4 is a plan view of the inflatable bag shown in FIG. 2 and illustrating in phantom a patient's foot positioned over the inflatable bag.
Figure 4F:
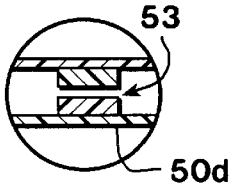
FIG. 4F is an enlarged cross-sectional view of the restrictive orifice in the fourth tubular line shown in FIG. 4.
Figure 5:
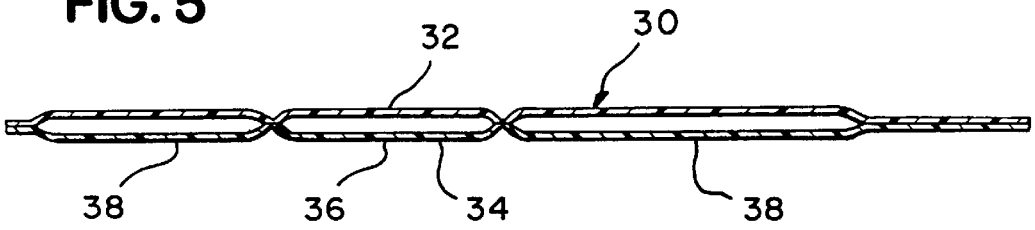
FIG. 5 is a cross-sectional view taken along section line 5—5 in FIG. 4.

In the embodiment illustrated in FIGS. 1, 2 and 4, the conducting line 50 comprises a first tubular line 50a connected at its distal end to the first bladder 36, a second tubular line 50*b* connected at its distal end to the second bladder 38, a third tubular line 50*c* connected at its distal end to a proximal end of the first tubular line 50*a*, a fourth tubular line 50*d* connected at its distal end to a proximal end of the second tubular line 50*b*, and a fifth tubular line 50*e* integrally formed at its distal end with proximal ends of the third and fourth tubular lines 50*c* and 50*d*. The fourth tubular line 50*d* is provided with a restrictive orifice 53 for preventing delivery of fluid into the second bladder 38 at the same rate at which fluid is delivered into the first bladder 36 see also FIG. 4F. More specifically, the restrictive orifice 53 is dimensioned such that the fluid pressure in the first bladder 36 is greater than the fluid pressure level in the second bladder 38 during substantially the entirety of the inflation cycle.

Figure 4A:
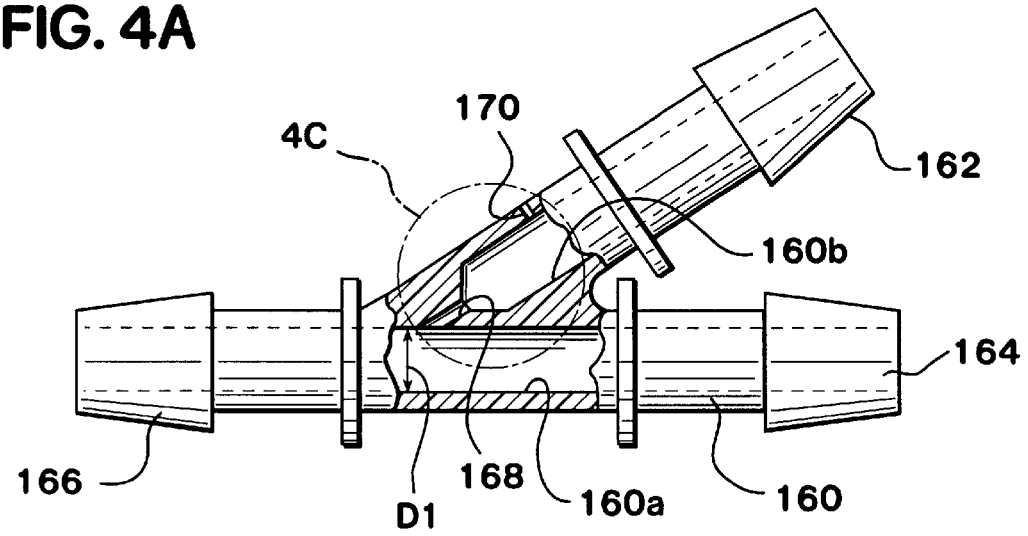
FIG. 4A is a side view, partially in cross-section, of a Y-connector forming part of a conducting line constructed in accordance with a second embodiment of the present invention.
Figure 4B:
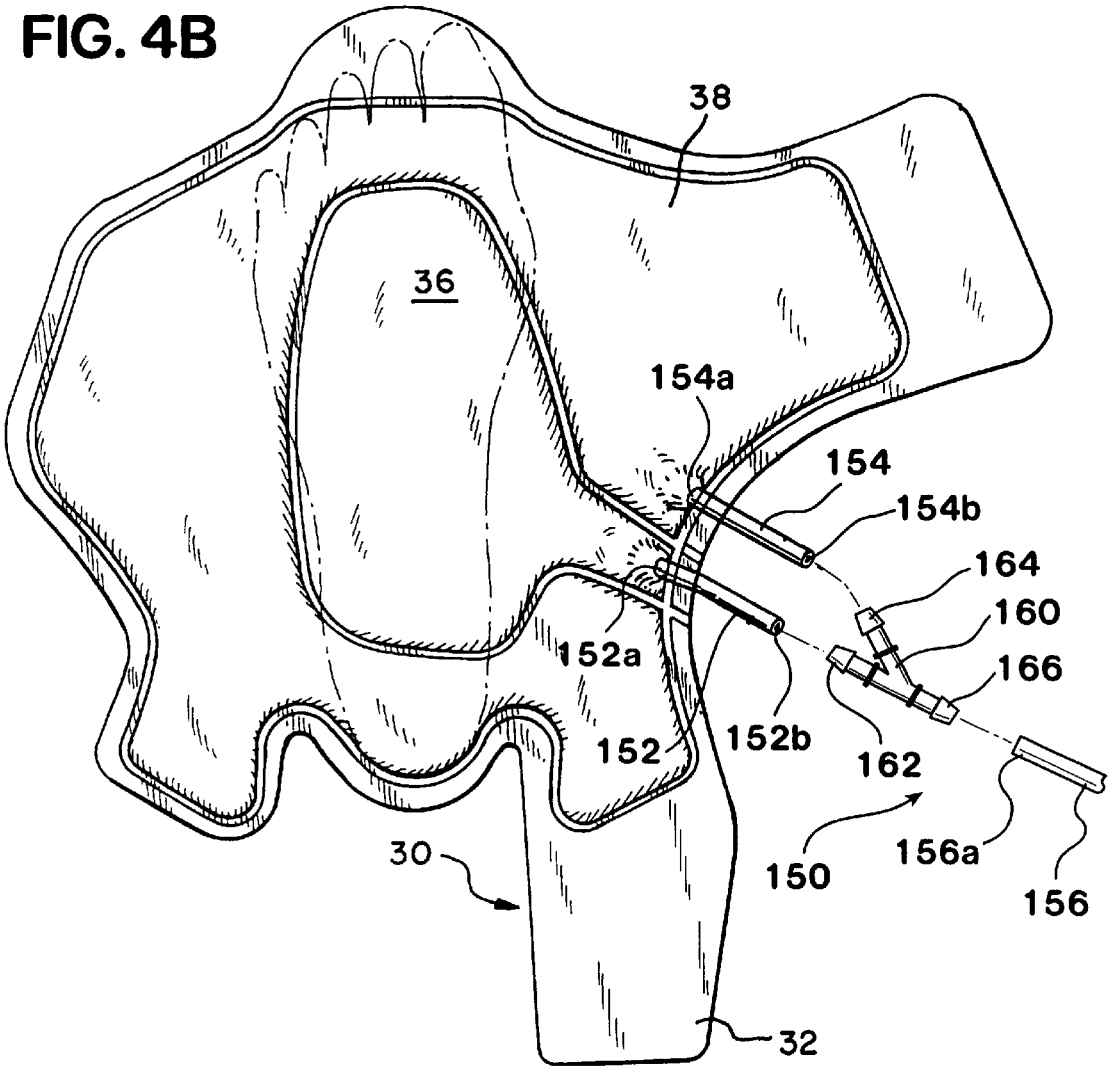
FIG. 4B is a plan view of an inflatable bag and a portion of a conducting line constructed in accordance with the second embodiment of the present invention.

A conducting line 150 and inflatable bag 30, formed in accordance with a second embodiment of the present invention, are shown in FIG. 4B, where like reference numerals indicate like elements. In this embodiment, the conducting line 150 (also referred to herein as a fluid conductor) comprises a first tubular line 152 connected at its distal end 152*a* to the first bladder 36, a second tubular line 154 connected at its distal end 154*a* to the second bladder 38, a Y-connector 160 connected at its first distal end 162 to a proximal end 152*b* of the first tubular line 152 and at its second distal end 164 to a proximal end 154*b* of the second tubular line 154, and a third tubular line 156 connected at its distal end 156*a* to a proximal end 166 of the Y-connector 160. The Y-connector 160 further includes a restrictive orifice 168 for preventing delivery of fluid into the second bladder 38 at the same rate at which fluid is delivered into the first bladder 36, see FIGS. 4A and 4C. The restrictive orifice 168 is dimensioned such that the fluid pressure in the first bladder 36 is greater than the fluid pressure level in the second bladder 38 during substantially the entirety of the inflation cycle. The proximal end of the third tubular line 156 is provided with a mating connector (not shown) which is substantially similar to mating connector 51 described above.

Figure 4C:
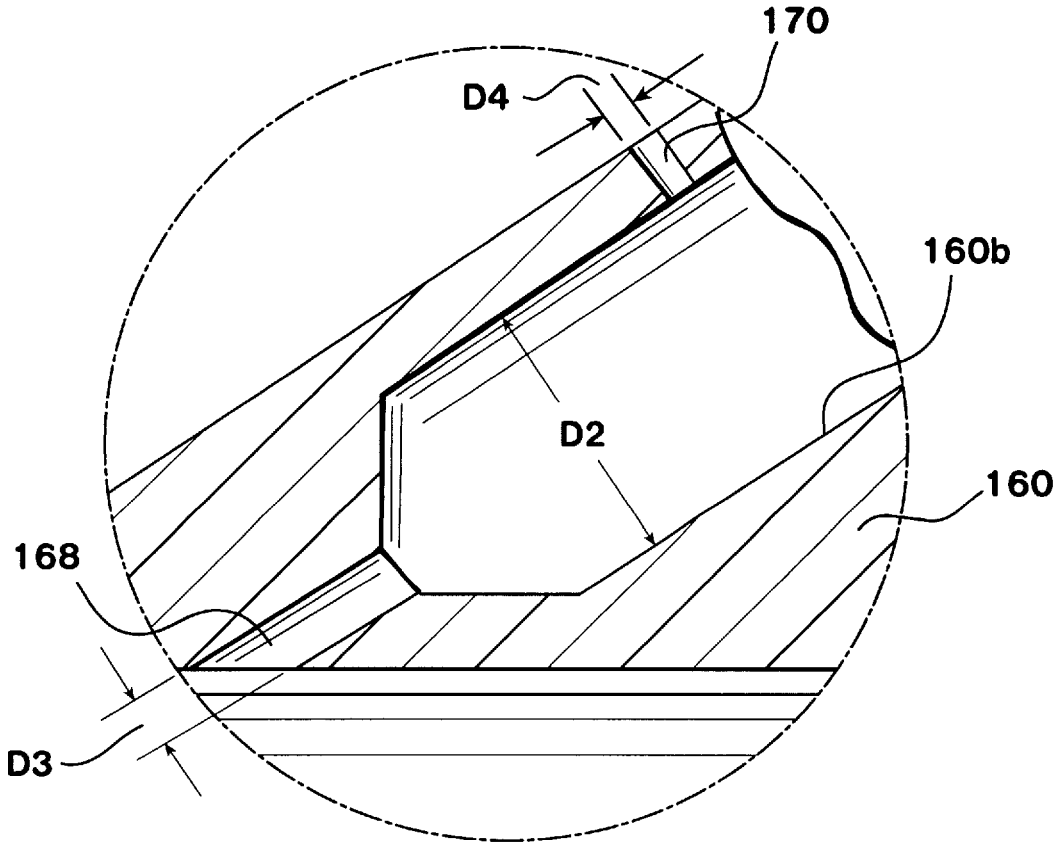
FIG. 4C is an enlarged view of a portion of the Y-connector shown in FIG. 4A.

A safety vent port 170 is provided in the Y-connector 160, see FIGS. 4A and 4C. Should a power failure occur during an inflation cycle with the vent valve in its closed position, pressurized fluid within the first and second bladders 36 and 38 will slowly decrease with time due to venting of the pressurized fluid through the safety vent port 170. The vent port 170 also serves to vent pressurized fluid to atmosphere in the unlikely event that the fluid generator 40 malfunctions such that the fluid generator inflate and vent solenoids and associated valves permit unrestricted flow of pressurized fluid into the bag 30.

Referring to FIGS. 4A and 4C, an example Y-connector 160 formed in accordance with the second embodiment of the present invention will now be described. The passage 160*a* of the Y-connector 160 has an inner diameter $D_1$=0.09 inch. The passage 160*b* has an inner diameter $D_2$=X inch. The restrictive orifice 168 has an inner diameter $D_3$=0.020 inch. The vent port 170 has an inner diameter $D_4$=0.013 inch. Of course, the dimensions of the Y-connector passages 160*a* and 160*b*, the restrictive orifice 168 and the vent port 170 can be varied in order to achieve desired inflation and vent rates.

Figures 4D, 4G:
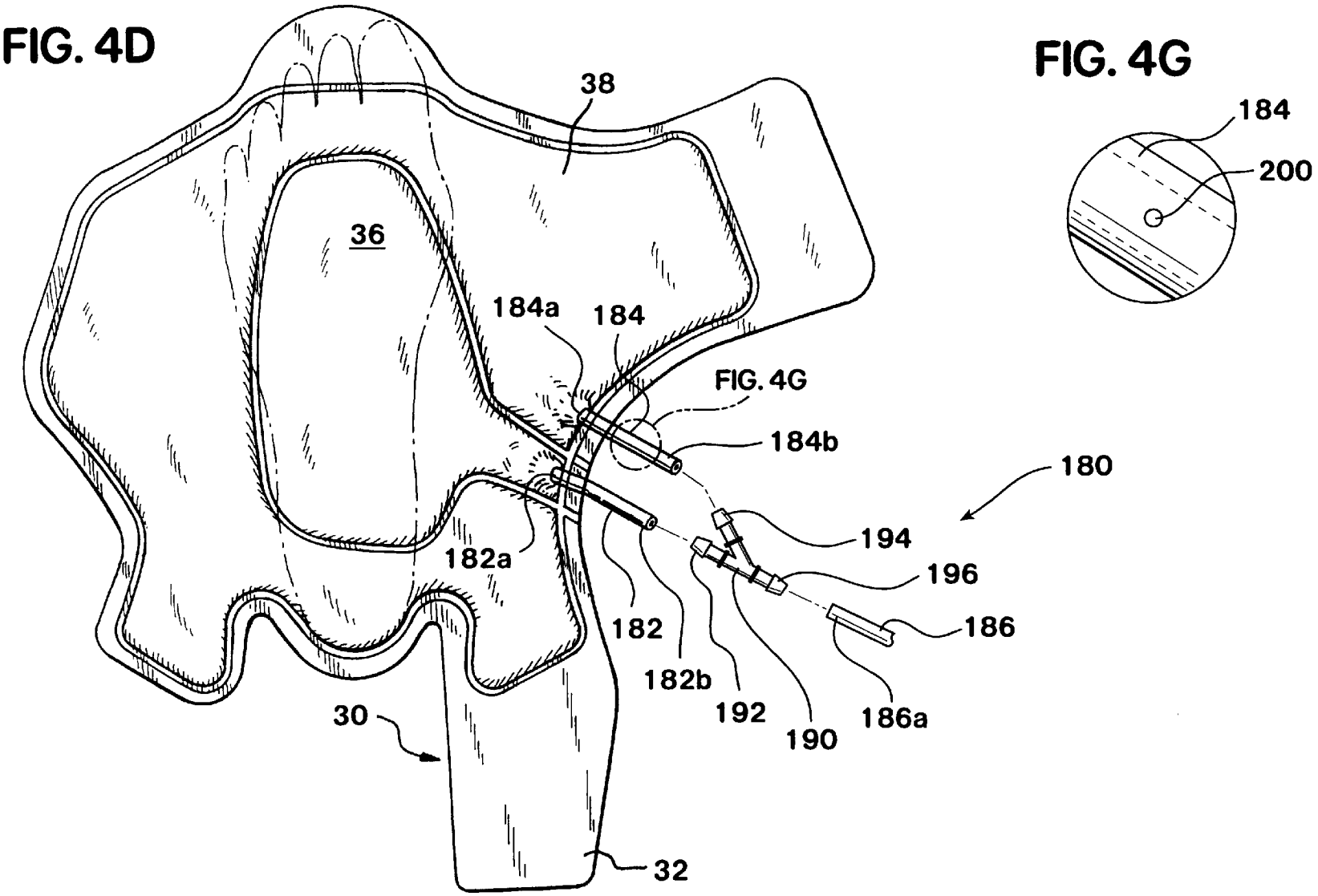
FIG. 4D is a plan view of an inflatable bag and a portion of a conducting line constructed in accordance with a third embodiment of the present invention.
FIG. 4G is an enlarged view of the safety vent port provided in the first tubular line shown in FIG. 4D.

A conducting line 180 and inflatable bag 30, formed in accordance with a third embodiment of the present invention, are shown in FIG. 4D, where like reference numerals indicate like elements. In this embodiment, the conducting line 180 (also referred to herein as a fluid conductor) comprises a first tubular line 182 connected at its distal end 182*a* to the first bladder 36, a second tubular line 184 connected at its distal end 184*a* to the second bladder 38, a Y-connector 190 connected at its first distal end 192 to a proximal end 182*b* of the first tubular line 182 and at its second distal end 194 to a proximal end 184*b* of the second tubular line 184, and a third tubular line 186 connected at its distal end 186*a* to a proximal end 196 of the Y-connector 190. The Y-connector 190 further includes a restrictive orifice (not shown) which is substantially similar to restrictive orifice 168 shown in FIGS. 4A and 4C. The restrictive orifice is dimensioned such that the fluid pressure in the first bladder 36 is greater than the fluid pressure level in the second bladder 38 during substantially the entirety of the inflation cycle. A safety vent port 200 is provided in the first tubular line 182 and functions in substantially the same manner as vent port 170 described above, see FIGS. 4D and 4G. The proximal end of the third tubular line 186 is provided with a mating connector (not shown) which is substantially similar to mating connector 51 described above.

Figures 4E, 4H:
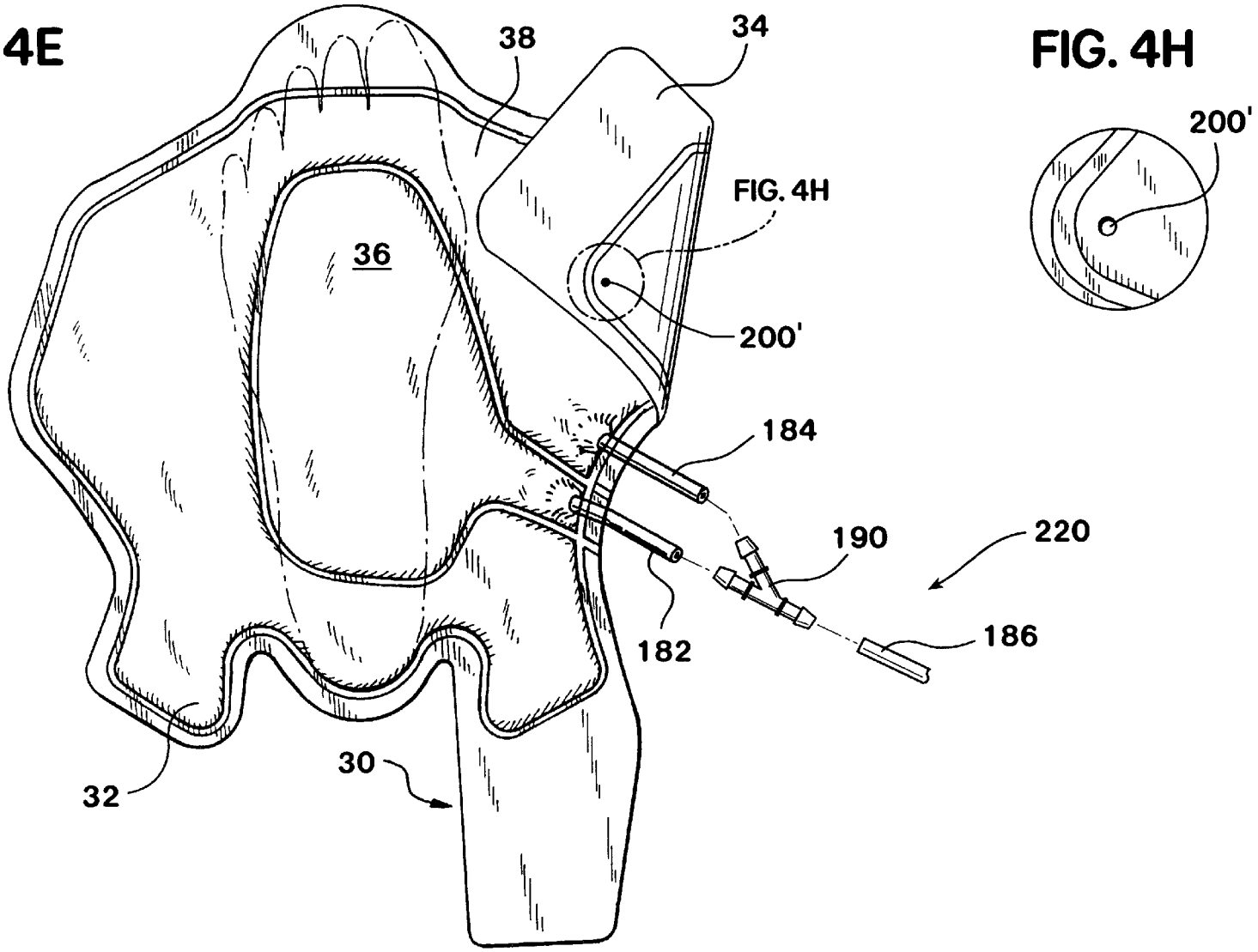
FIG. 4E is a plan view of an inflatable bag and a portion of a conducting line constructed in accordance with a fourth embodiment of the present invention.
FIG. 4H is an enlarged view of the safety vent port provided in the second panel of the bag shown in FIG. 4E.

A conducting line 220 and inflatable bag 30, formed in accordance with a fourth embodiment of the present invention, are shown in FIG. 4E, where like reference numerals indicate like elements. In this embodiment, the safety vent port 200' is provided in the second panel 34 of the bag 30 such that the vent port 200' communicates directly with the second bladder 38, see also FIG. 4H.

The front panel 42*a* is further provided with a liquid crystal display (LCD) 42*c* for displaying the stored operating pressure value and the stored operating time period. The LCD 42*c* also serves to indicate via a visual warning if either or both of the first or second conducting lines are open or obstructed. Light-emitting diodes 42*d* are also provided for indicating whether the generator 40 is operating in the keypad input mode or the processor input mode. Light-emitting diodes 42*f* indicate which fluid outlets are active.

When a fluid pulse is generated by the generator 40, pressurized fluid is transmitted to the bag 30 via the conducting line 50. This results in the first fluid bladder 36 applying a first compressive pressure generally at the plantar arch 62 and the second bladder 36 applying a second, distinct compressive pressure generally at the dorsal aspect 66, the heel 64 and the forward portion 67 of the sole 68 of the foot 60. Application of compressive pressures upon these regions of the foot 60 effects venous blood flow in the deep plantar veins. When a second boot (not shown) is employed, pressurized fluid pulses are transmitted by the generator 40 to its associated inflatable bag so as to effect venous blood flow in the patient's other foot.

Figure 9:
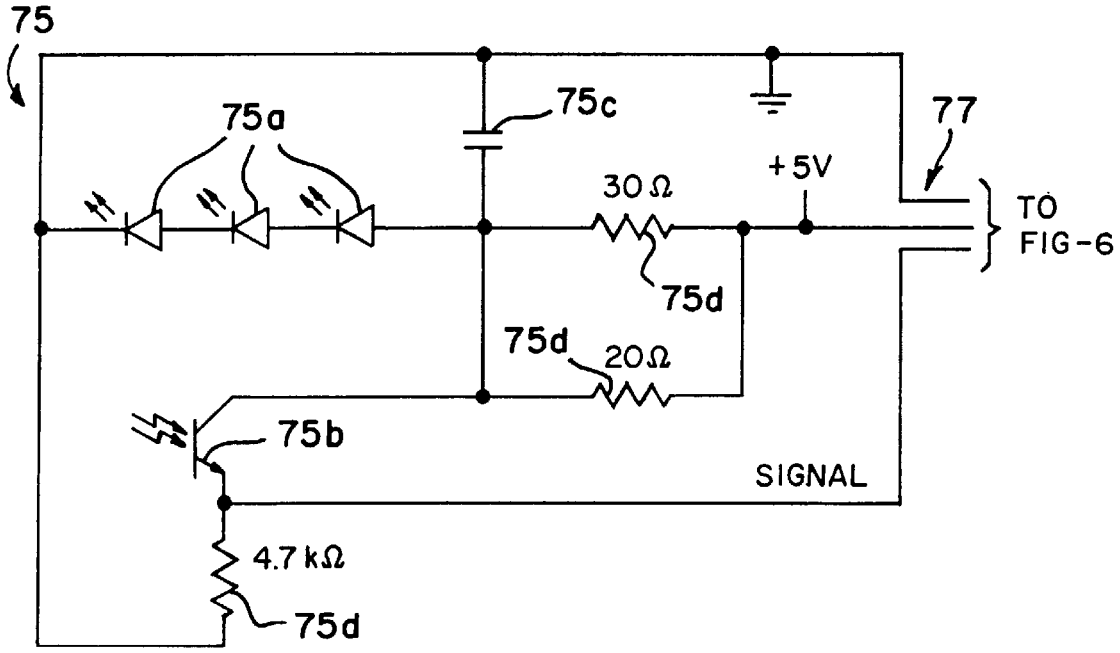
FIG. 9 is a circuit diagram for the infrared sensor illustrated in FIG. 1.

The apparatus 10 further includes an infrared sensor 75, see FIGS. 1 and 9. The sensor 75 can be used in combination with the fluid generator 40 and the processor 70 to allow a physician to prescreen patients before prescribing use of one or two of the boots 20 and the fluid generator 40. The prescreening test ensures that the patient does not have a venous blood flow problem, such as deep vein thrombosis. The prescreening test also allows the physician to predict for each individual patient a preferred time period for vent cycles.

In the illustrated embodiment, the sensor 75 is operatively connected through the generator 40 via cable 77 to the processor 70, see FIGS. 1, 6 and 9. The sensor 75 comprises three infrared-emitting diodes 75*a* which are spaced about a centrally located phototransistor 75*b*. The sensor 75 further includes a filtering capacitor 75*c* and three resistors 75*d*.

The sensor 75 is adapted to be secured to the skin tissue of a patient's leg approximately 10 cm above the ankle via a double-sided adhesive collar (not shown) or otherwise. The diodes 75*a* emit infrared radiation or light which passes into the skin tissue. A portion of the light is absorbed by the blood in the microvascular bed of the skin tissue. A remaining portion of the light is reflected towards the phototransistor 75*b*. An analog signal generated by the phototransistor 75*b* varies in dependence upon the amount of light reflected towards it. Because the amount of light reflected varies with the blood volume in the skin tissue, the analog signal can be evaluated to determine the refill time for the microvascular bed in the skin tissue (also referred to herein as the LRR refill time). Determining the microvascular bed refill time by evaluating a signal generated by a phototransistor in response to light reflected from the skin tissue is generally referred to as light reflection rheography (LRR).

To run the prescreening test, the sensor 75 is first secured to the patient in the manner described above. The patient is then instructed to perform a predefined exercise program, e.g., 10 dorsiflexions of the ankle within a predefined time period, e.g., 10 seconds. In a normal patient, the venous blood pressure falls due to the dorsiflexions causing the skin vessels to empty and the amount of light reflected towards the phototransistor 75*b* to increase. The patient continues to be monitored until the skin vessels are refilled by the patient's normal blood flow.

The signals generated by the phototransistor 75*b* during the prescreening test are buffered by the controller 44 and passed to the processor 70 via the interface cable 72. A digitizing board (not shown) is provided within the processor 70 to convert the analog signals into digital signals.

In order to minimize the effects of noise, the processor 70 filters the digital signals. The processor 70 filters the digital signals by taking 7 samples of sensor data and arranging those samples in sequential order from the lowest value to the highest value. It then selects the middle or "median" value and discards the remaining values. Based upon the median values, the processor 70 then plots a light reflection rheography (LRR) curve. As is known in the art, a physician can diagnose whether the patient has a venous blood flow problem from the skin tissue refill time taken from the LRR curve. An example LRR curve for a normal patient is shown in FIG. 10.

When the sensor 75 is initially secured to the patient's leg, its temperature increases until it stabilizes at approximately skin temperature. Until temperature stabilization has occurred, the signal generated by the sensor 75 varies, resulting in inaccuracies in the LRR curve generated by the processor 70. To prevent this from occurring, the processor 70 monitors the signal generated by the sensor 75 and produces the LRR curve only after the sensor 75 has stabilized. Sensor stabilization is particularly important because, during the stabilization period, the signals generated by the sensor 75 decline at a rate close to the rate at which the skin vessels refill.

Figure 11:
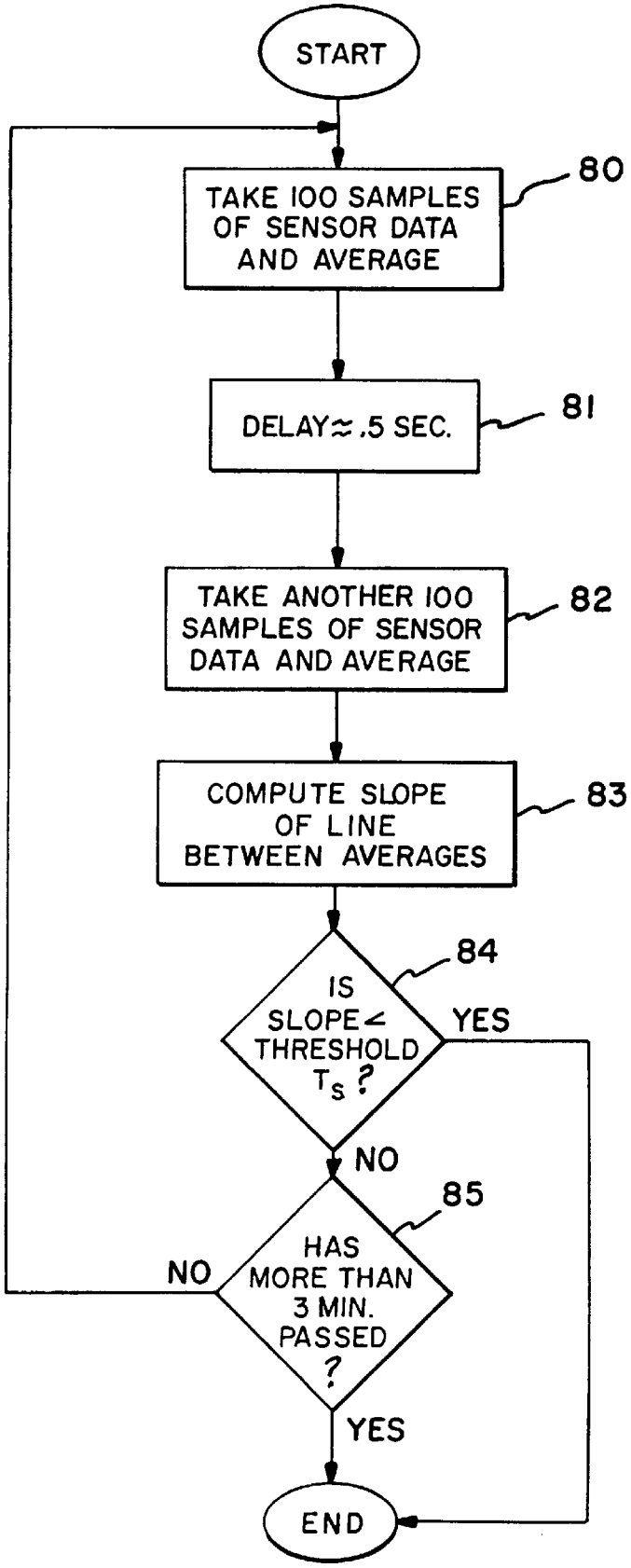
FIG. 11 is a flow chart depicting steps performed to determine stabilization of the infrared sensor signal; and, FIG. 12 is a flow chart depicting steps performed to determine the endpoint on the LRR curve and the LRR refill time.

FIG. 11 shows in flow chart form the steps which are used by the processor 70 to determine if the signal generated by the sensor 75 has stabilized. The first step 80 is to take 100 consecutive samples of filtered sensor data and obtain an average of those samples. After delaying approximately 0.5 second, the processor 70 takes another 100 consecutive samples of sensor data and obtains an average of those samples, see steps 81 and 82. In step 83, the processor 70 determines the slope of a line extending between the averages of the two groups sampled. In step 84, the processor 70 determines if the magnitude of the slope is less than a predefined threshold value $T_s$, e.g., $T_s$=0.72. If it is, stabilization has occurred. If the magnitude of the slope is equal to or exceeds the threshold value $T_s$, the processor 70 determines whether 3 minutes have passed since the sensor 75 was initially secured to the patient's skin, see step 85. Experience has shown that stabilization will occur in any event within 3 minutes. If 3 minutes have passed, the processor 70 concludes that stabilization has occurred. If not, it repeats steps 80–85.

Figure 10:
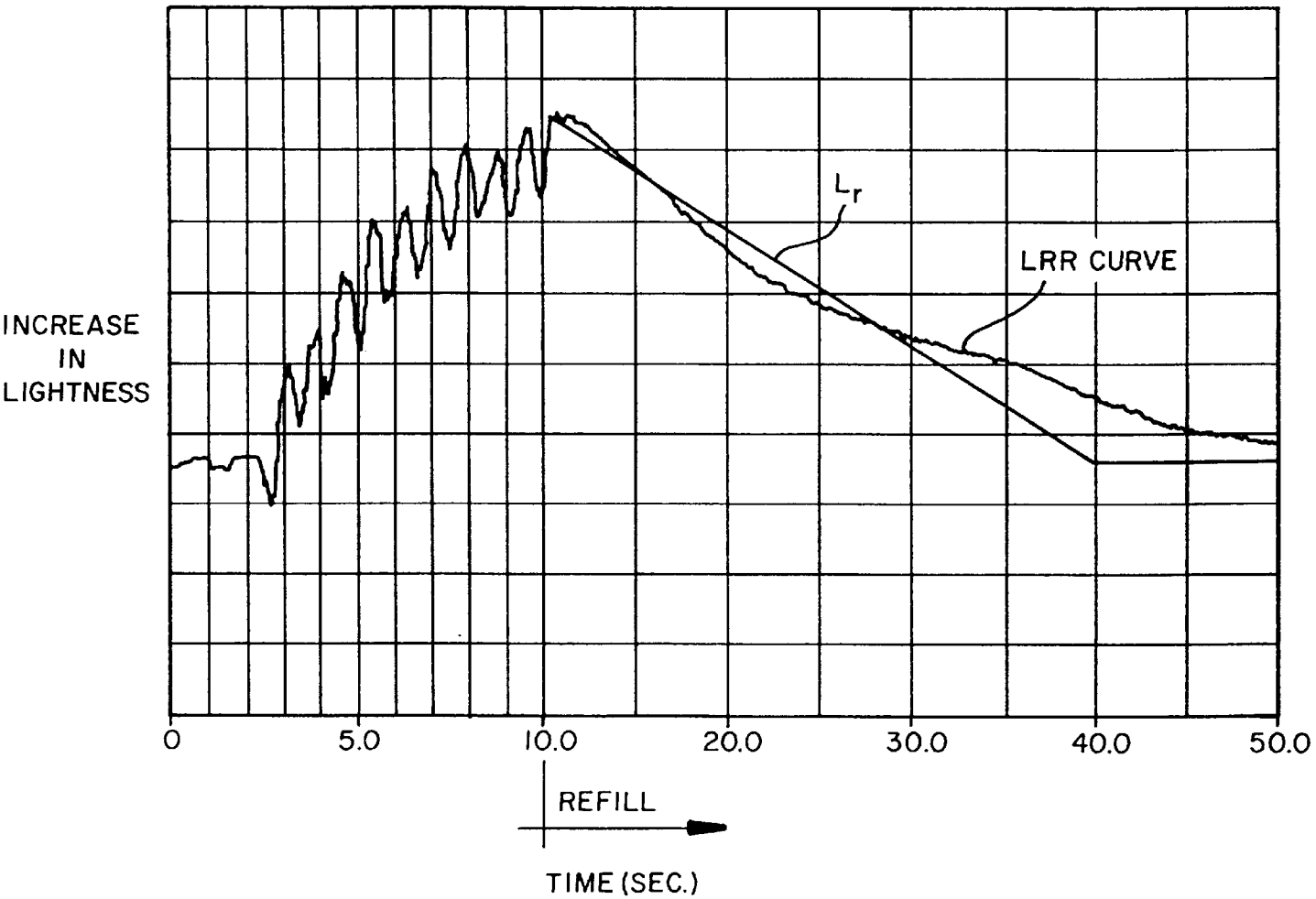
FIG. 10 is an example LRR curve for a normal patient.

After generating the LRR curve, the processor 70 further creates an optimum refill line $L_r$ and plots the line $L_r$ for comparison by the physician with the actual LRR curve, see FIG. 10. The optimum refill line $L_r$ extends from the maximum point on the plotted LRR curve to a point on the baseline, which point is spaced along the X-axis by a selected number of seconds. It is currently believed that this time along the X-axis should be 30 seconds from the X-component of the maximum point; however other times close to 30 seconds may ultimately prove superior.

Figure 12:
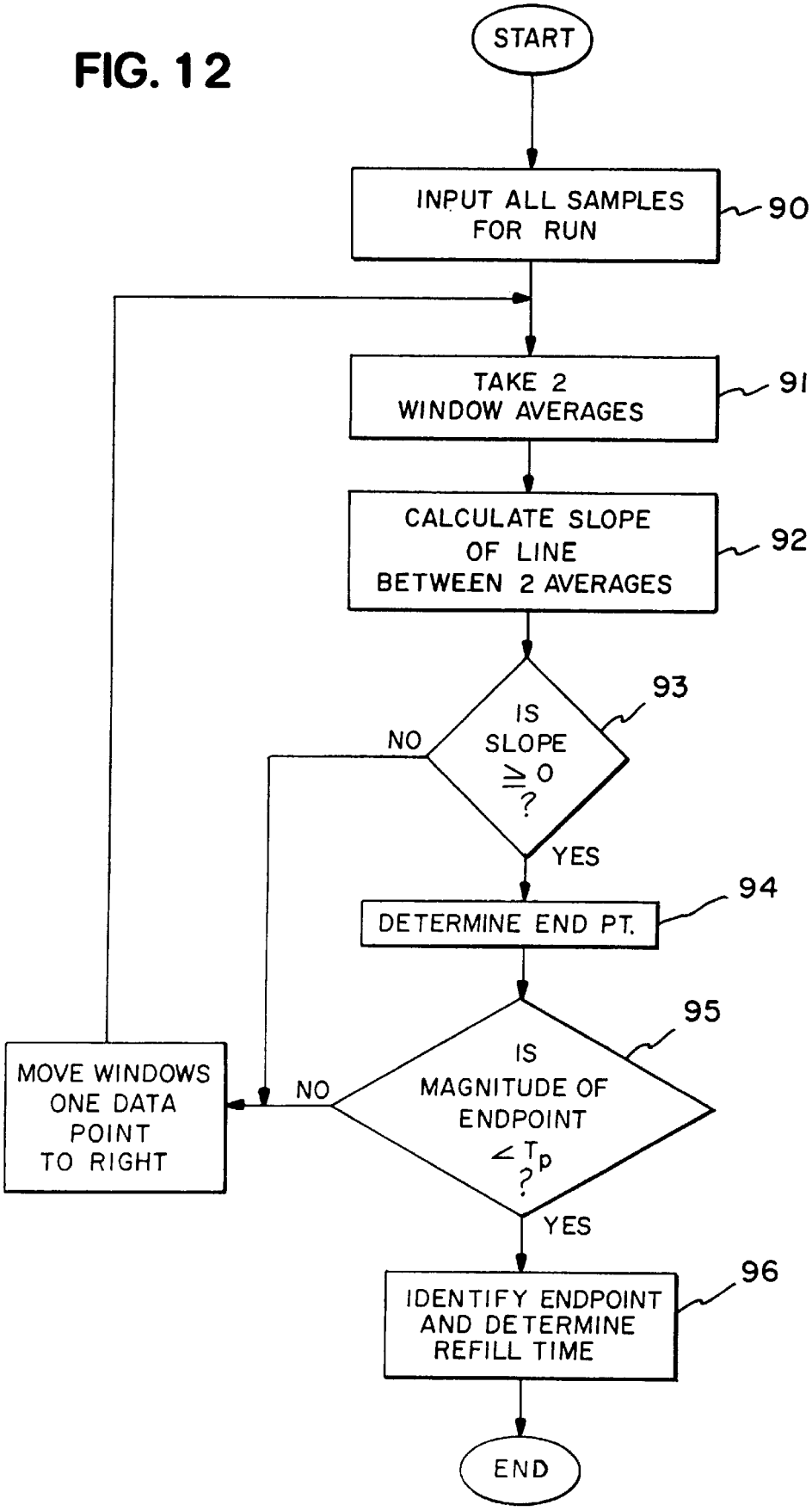

The processor 70 generates the endpoint of the LRR curve and the LRR refill time. FIG. 12 shows in flow chart form the steps which are used by the processor 70 to determine the endpoint on the LRR curve and the refill time.

In step 90, all filtered samples for a single prescreening test are loaded into the processor 70. In step 91, two window averages are determined. In a working embodiment of the invention, each window average is determined from 30 filtered data points, and the two window averages are separated by 5 filtered data points. Of course, other sample sizes for the windows can be used in accordance with the present invention. Further, the number of data points separating the windows can be varied. In step 92, the slope of a line extending between the two window averages is found. In step 93, if the slope is less than 0, the processor 70 moves the windows one data point to the right and returns to step 91. If the slope is greater than or equal to zero, the processor 70 determines the endpoint, see step 94. The endpoint is determined by identifying the lowest and highest data points from among all data points used in calculating the two window averages and taking the centerpoint between those identified data points. The processor then determines if the magnitude of the endpoint is less than a threshold value $T_p$ (e.g., $T_p$=[peak value−(0.9) (peak value−baseline value)]), see step 95. If the endpoint is greater than or equal to the threshold value $T_p$, the processor 70 moves the windows one data point to the right and returns to step 91. If the endpoint is less than the threshold value $T_p$, the processor 70 identifies the endpoint and calculates the LRR refill time, see step 96. The LRR refill time is equal to the time between the maximum point on the LRR curve and the endpoint.

Further in accordance with the present invention, the processor 70 determines a preferred time period for the periodic vent cycles by estimating the refill time period for the patient's deep plantar veins based upon the determined LRR refill time. In order to determine the refill time period for the deep plantar veins, an equation is generated in the following manner.

LRR plots for a group of patients are generated in the manner described above using the boot 20, the inflatable bag 30, the fluid generator 40, the processor 70 and the sensor 75. The group must include patients ranging, preferably continuously ranging, from normal to seriously abnormal. The LRR refill time is also generated for each of these patients.

Refill times for the deep plantar veins are additionally determined for the patients in the group. The refill time is determined for each patient while he/she is fitted with the boot 20 and the inflatable bag 30 has applied compressive pressures to his/her foot. An accepted clinical test, such as phlebography or ultrasonic doppler, is used to determine the refill time for the deep plantar veins.

Data points having an X-component equal to the LRR refill time and a Y-component equal to the refill time for the deep plantar veins are plotted for the patients in the group. From those points a curve is generated. Linear regression or principal component analysis is employed to generate an equation for that curve. The equation is stored in the processor 70.

From the stored equation, the processor 70 estimates for each patient undergoing the prescreening test the patient's deep plantar veins refill time based upon the LRR refill time determined for that patient. The preferred time period for the periodic vent cycles is set equal to the deep plantar veins refill time and that preferred time period is transmitted by the processor 70 to the controller 44 for storage by the controller 44 as the operating time period for the periodic vent cycles.

It is further contemplated by the present invention that a look-up table, recorded in terms of LRR refill time and deep plantar veins refill time, could be stored within the processor 70 and used in place of the noted equation to estimate the preferred time period for the periodic vent cycles.

A program listing (written in Basic) in accordance with the present invention including statements for (1) determining stabilization of the sensor 75; (2) median filtering; and (3) determining the endpoint of the LRR curve is set forth below:

NDM 196 IA - 23 -

```
5 REM
  rem
  rem
  rem
  rem
  rem
  rem
  rem
  rem

  dim stemp(100),wrd(4),tword(7)

  out &h02f0,&h04                    'reset the A/D's
  for dly=1 to 5000:next dly
  out &h02f0,&h18                    'get ready for sampling

open "I",#4,"CVI.INI"

        cls:screen 9
        line (0,0)-(639,349),15,b
        line (3,3)-(636,346),15,b

input #4,cport

input #4,d$:input #4,pth$
close #4

locate 4,5:input "Patients Name (First initial and Last):";iname$
        iname$=iname$ + "          "   'add padding spaces for short names
        iname$=left$(iname$,10)
        8 locate 5,5:input "Patients Age:";iage
        if iage>100 then 8
        locate 6,5:input "Which leg (right, left):";ileg$
        ileg$=ileg$ + "     "          'add space padding
        ileg$=left$(ileg$,5)

        calflag=0

9 gosub 8000   'Wait on sensor temperature stabilization

10 CLS
15 DIM CVT(1441),overlay(1441)
16 XORG=75:YORG=278:PI=3.1415927#
17 FLAG=1:F$="##.##":G$="##.#"

   rem <<Initialize the gain settings and D.P. variables>>
        G#=25.00#          'initial gain setting
        bias#=75.00#       'set this where you want the trace bottom
        ybase#=-1000.00#   'trigger the calibration message on 1st pass
        gmax#=25.00#       'sets the maximum allowable gain  (35 orig.)
        maxdelta#=0.00#    'setup max and min for actual range
        mindelta#=210.00#
        fillchk=0

80 gosub 11000  'display setup
        LOCATE 23,5
        PRINT "X=RETURN TO DOS  <Spc Bar>=CVI TEST  O=OVERLAY  S=STORE/RETRIEVE

188 GOSUB 1000
```

NDM 196 IA - 24 -

```
190 gosub 11100 'display blinking

280 REM  DATA DISPLAY ROUTINE

320 REM **** Get input and display point ****
325 erase CVT:sum=0:yavg#=0.0#:calflag=1:maxdelta#=0.0#:mindelta#=210.0#

        name$=iname$:leg$=ileg$:age=iage
        patdat$=date$:pattim$=time$
        locate 3,5:print patdat$;" || ";pattim$;
        locate 3,31:print "Patient: ";name$;:locate 3,53:print "Age: ";age;
        locate 3,64:print "<";leg$;" Leg>";
        locate 24,28:print "Refill Time (SEC): ";using "##.#";0.0;

   rem << DO the Baseline Request (BRQ) >>
   for j=1 to 5
   gosub 2000
   yavg#=yavg#+temp#
   next j
   ybase#=yavg#/5.0#

330 FOR I=1 TO 1440:skip=0
    if i>480 then skip=1
331 for jx=1 to skip:gosub 2000:next jx     'wait skip sample intervals

    rem *** Standard plot for reference - (green line)***
    if i<=504 then 332
    ystep=ystep-(CVT(504)-bias#)/720
    if ystep<bias# then ystep=bias#
    if i=505 and CVT(504)<203 then
      circle(XORG+I/1440*490,yorg-Ystep),7,12       'ident fillrate start
      circle(XORG+I/1440*490,yorg-Ystep),8,12
      fillchk=1
    end if
    if CVT(504)>131 then pset (XORG+I/1440*490,yorg-Ystep),10

332 k$=inkey$:if k$="" then 333

    rem *** Interrupt Sequence ***
    for rmdr=i to 1440:CVT(rmdr)=yval:next rmdr
    colr=15
    ovlflg=0   'disable any overlaying on an abort sequence
    fillchk=0:fillrate=0
    gosub 7000
    goto 420  'escape sequence

333 rem metronome setup for 10 dorsiflexions
    rem start signal
    if i=48 then sound 500,10
    iraw=i/39:iint=int(i/39)
    if i>80 and i<470 and iraw=iint then sound 1200,1

335 gosub 2000   'gosub 2000 get input subroutine
336 CVT(I)=yval
    if i=504 then ystep=yval
    if ydelta#>maxdelta# then maxdelta#=ydelta#
    if ydelta#<mindelta# then mindelta#=ydelta#

400 LINE (XORG+(I-1)/1440*490,YORG-CVT(I-1))-(XORG+I/1440*490,YORG-CVT(I)),15
```

NDM 196 IA - 25 -

```
408 NEXT I

    rem *** Routine to find trace endpoint and calculate filltime ***
    if fillchk=1 then        'find the trace endpoint

    for i=505 to 1410        'scan through all samples
    cvtsum1=0:cvtsum2=0
    for n=1 to 30:cvtsum1=cvtsum1+cvt(i+n-35):cvtsum2=cvtsum2+cvt(i+n):next n
    cvtavg1=cvtsum1/30:cvtavg2=cvtsum2/30
    diff=(cvtavg2-cvtavg1)

    if diff > -.50 and cvt(i) < .10 * (cvt(504)-bias#) + bias# then
       for n=1 to 30
       if abs(cvt((i-15)+n)-cvt(i))>9 then 409   'artifact rejection
       next n
       fulptr=i
       if cvt(fulptr)<7 then 410   'don't print endpoint circle (bottom)
       circle(XORG+fulptr/1440*490,YORG-CVT(fulptr)),7,12   'ident fillrate sto
       circle(XORG+fulptr/1440*490,YORG-CVT(fulptr)),8,12
       goto 410
    end if

409 next i

       fulptr=1419
       if cvt(fulptr)<7 then 410   'don't print endpoint circle (bottom)
       circle(XORG+fulptr/1440*490,YORG-CVT(fulptr)),7,12   'ident fillrate sto
       circle(XORG+fulptr/1440*490,YORG-CVT(fulptr)),8,12

410    fillrate= (fulptr-504)/24
       fillrate=int(fillrate*10)/10
       fillchk=0
    end if

    locate 24,28:print "Refill Time (SEC): ";using "##.#";fillrate;

    deltamax#=(maxdelta#-mindelta#)
    if deltamax#=0 then deltamax#=1
    gosub 2600   'do the nominal gain adjust

420 rem <end of pass>
422 LET K$=INKEY$:IF K$="x" OR K$="X" THEN STOP
424 IF K$="S" OR K$="s" THEN GOSUB 5000 ' FILE ROUTINE
425 IF K$="O" OR K$="o" THEN gosub 9000 'overlay handler
427 IF K$=" " THEN GOTO 190  'check for stable temp here!!!
430 IF K$="" THEN 422    'wait for keypress
460 GOTO 422

465 rem DIRECTORY
       cls
       files d$+pth$
       locate 24,5:print"Press any key to continue:";
468    k$=inkey$:if k$="" then 468
       cls
       gosub 11000  'display setup
       if vect=2 then goto 9000  'return to overlay routine
       goto 5000                 'return to file routine

1000 REM introduction
1004 LOCATE 10,27:PRINT"CVI TEST AND STORE OPTION"
```

NDM 196 IA

```
1006 LOCATE 15,15:PRINT"Pl  s SPC BAR TO START TEST, ESC TO RETURN TO SYSTEM"
1010 LET K$=INKEY$:IF K$="" THEN 1010
1020 IF asc(K$)=27 THEN SYSTEM
1024 IF K$="S" OR K$="s" THEN GOSUB 5000:goto 420 ' FILE ROUTINE
1025 IF K$="x" OR K$="X" THEN CLS:STOP
1030 if k$=" " then RETURN
1040 goto 1010

1500 rem *** Calibrate message ***
1520 line(130,195)-(500,255),15,bf
1530 locate 16,23:print "  Attention!! System is Calibrating  "
1540 locate 17,23:print "  Wait until finished, then Retest.  "
1545 calflag=0
1560 return

2000 REM ***Get input value from A/D converter***
     'includes software fixes for lousy a/d converter equipment
     for smpl=1 to 5              'take 5 samples
     out &h02f0,&h08              'strobe HOLD and take a sample
     out &h02f0,&h18              'reset for next sample
     for dly=1 to 86:next dly
     let msb=inp(&h02f6)
     let lsb=inp(&h02f6)
     tword(smpl)=(256*msb+lsb)
     next smpl
     for g=1 to 4                 'bubble sort for median value
     for h=1 to 4
     if tword(h)>tword(h+1) then
        temp=tword(h)
        tword(h)=tword(h+1)
        tword(h+1)=temp
     end if
     next h
     next g

2047 csword#=tword(3)                 'choose median value
     TEMP#=csword#/65536.0#*210.0#   'scale and convert to pixel space
     ydelta#=(temp#-ybase#)
     yval=G#*ydelta#+bias#
     if yval>210 then yval=210
     if yval>207 and calflag=1 then gosub 1500
     if yval<0 then yval=0
2050 RETURN

2600 rem << Nominal Gain Adjust >>
     maxpixel#=195.00#
     G#=(maxpixel#-bias#)/deltamax#     'set the new gain
     if G#>gmax# then G#=gmax#
2610 return

4005 gosub 11100  'redraw cvi display
4060 FOR I=1 TO 1440
4070 LINE(XORG+(I-1)/1440*490,YORG-CVT(I-1))-(XORG+I/1440*490,YORG-CVT(I)),15
4080 NEXT I
4085 LOCATE 23,5:PRINT"X=RETURN TO DOS  <Spc Bar>=CVI TEST  O=OVERLAY  S=STORE/R
     locate 3,5:color 15:print patdat$;" || ";pattim$;
     locate 3,31:print "Patient: ";name$;:locate 3,53:print "Age: ";age;
     locate 3,64:print "<";leg$;" Leg>";
     locate 24,28:print "Refill Time (SEC): ";using "##.#";fillrate;
4090 K$="":RETURN
```

NDM 196 IA - 27 -

```
5000 REM FILE HANDLER
5001 c=0
5005 LINE(75,68)-(565,278),12,bf
5010 LOCATE 23,5:PRINT"
5170 LOCATE 8,14:PRINT"<S>AVE FILE"
5175 LOCATE 10,15:PRINT "FILE NAME"
5177 LOCATE 12,13:PRINT d$;"___________.DAT"
5190 LOCATE 15,12:PRINT"<R>ETRIEVE FILE"
5210 LOCATE 17,15:PRINT"FILE NAME"
5230 LOCATE 19,13:PRINT d$;"___________.DAT"
5340 LOCATE 6,14:PRINT"<M>AIN MENU":locate 6,50:print"<D>irectory"

5400 REM ** Input handler **
5410 LET K$=INKEY$:IF K$="" THEN 5410
5420 IF K$="M" OR K$="m" THEN colr=11:GOTO 7000  ' REDRAW DISPLAY
5430 IF K$="R" OR K$="r" THEN GOTO 5510
5440 IF K$="S" OR K$="s" THEN GOTO 5460
     if k$="D" or k$="d" then vect=1:goto 465
5450 GOTO 5410
5460 LOCATE 12,15,1     'SAVE
5465 PRINT "*";
5470 I$=INKEY$:IF I$="" THEN 5470
5474 IF ASC(I$)=13 THEN c=0:goto 5600
5475 IF ASC(I$)=8 THEN GOSUB 6750:goto 5470
5476 IF ASC(I$)=27 THEN 5000
5477 IF ASC(I$)<48 OR ASC(I$)>122 THEN 5470
5478 IF ASC(I$)>57 AND ASC(I$)<64 THEN 5470
5479 IF ASC(I$)>90 AND ASC(I$)<97 THEN 5470
5490 IF C<8 THEN sd$=sd$+I$:PRINT I$;:C=C+1
5500 GOTO 5470
5510 LOCATE 19,15,1     ' RETRIEVE  ROUTINE
5520 PRINT "*";
5530 I$=INKEY$:IF I$="" THEN 5530
5540 IF ASC(I$)=13 THEN c=0:goto 6600
5550 IF ASC(I$)=8 THEN GOSUB 6750:goto 5530
5560 IF ASC(I$)=27 THEN 5000
5570 IF ASC(I$)<48 OR ASC(I$)>122 THEN 5530
5580 IF ASC(I$)>57 AND ASC(I$)<64 THEN 5530
5590 IF ASC(I$)>90 AND ASC(I$)<97 THEN 5530
5595 IF C<8 THEN rt$=rt$+I$:PRINT I$;:C=C+1
5597 GOTO 5530

5600 REM ** Output file to Disk **
5605 ON ERROR GOTO 6710
5610 FILE$=d$+pth$+SD$+".DAT":SD$=""
5620 OPEN "O",#1,FILE$
5630 FOR SAMPLE=1 TO 1440
5640 WRITE #1,CVT(SAMPLE)
5650 NEXT SAMPLE
     write #1,name$,age,leg$,patdat$,pattim$,fillrate
5660 CLOSE #1
     colr = 15
5670 ovlflg=0:GOTO 7000 ' REDRAW DISPLAY

6600 REM **** INPUT FILE FROM DISK *******
6605 ON ERROR GOTO 6700
6610 FILE$=d$+pth$+RT$+".DAT":RT$=""
6620 OPEN "I",#1,FILE$
6630 FOR SAMPLE =1 TO 1440
```

NDM 196 1A - 28 -

```
6640 INPUT #1,CVT(SAMPLE)
6650 NEXT SAMPLE
     input #1,name$,age,leg$,patdat$,pattim$,fillrate
6660 CLOSE 1
     colr = 11
6670 ovlflg=0:GOTO 7000  ' DISPLAY NEW DATA

6700 REM ** Error Handling **
6705 LOCATE 23,5:PRINT "FILE NOT FOUND!":GOTO 6720
6710 LOCATE 23,5:PRINT "DISK DRIVE NOT READY!"
6720 FOR DLY=1 TO 55000:NEXT DLY
     close 1
6730 RESUME 5000
6740 END

6750 REM ***CORRECTION ALGORITHM***
6760 IF POS(X)<=16 THEN RETURN
6770 C=C-1
6780 SD$=LEFT$(SD$,C)
6785 RT$=LEFT$(RT$,C)
6790 BKS=POS(X)
6795 BKY=CSRLIN
6800 LOCATE BKY,(BKS-1)
6805 PRINT"_";
6810 LOCATE BKY,(BKS-1)
6820 RETURN

7000 REM reconstruct display and data routines
7001 CVT(0)=0
     gosub 11100  'redraw cvi display
7060 FOR I=1 TO 1440
7070 LINE(XORG+(I-1)/1440*490,YORG-CVT(I-1))-(XORG+I/1440*490,YORG-CVT(I)),15
     if ovlflg=1 then
     LINE(XORG+(I-1)/1440*490,YORG-overlay(I-1))-(XORG+I/1440*490,YORG-overlay(I
     end if
7080 NEXT I
7085 LOCATE 23,5:PRINT"X=RETURN TO DOS  <Spc Bar>=CVI TEST  O=OVERLAY  S=STORE/R
     locate 3,5:color colr:print patdat$;" || ";pattim$;
     locate 3,31:print "Patient: ";name$;:locate 3,53:print "Age: ";age;
     locate 3,64:print "<";leg$;" Leg>";
     locate 24,28:print "Refill Time (SEC): ";using "##.#";fillrate;
     color 15
7090 K$="":RETURN

8000 rem *** Wait on sensor temperature stabilization ***
        cls:screen 9
        line (0,0)-(639,349),15,b
        line (3,3)-(636,346),15,b
        G#=10.00#      'set gain value
        bias#=75.00#   'sets bias to active range
        locate 2,5
        print "<<<<<<<<<<<<<<<<<<<<<<<<<<<<<<<<< CVI Test >>>>>>>>>>>>>>>>>>>>>>>
        locate 4,5
        print "Attach the optical sensor to the patient's leg using the adhesive
        locate 5,5
        print "collar.  Locate the sensor four inches above the ankle on the
        locate 6,5
        print "interior side of the leg."
        locate 8,5
        print "Plug the sensor into the connector on the Powerpoint Hemopulse un
```

```
        locate 10,5
        print "<Press any key when finished, (B) to Bypass warmup>"
8010    k$=inkey$:if k$="" then 8010
        if k$="B" or k$="b" then return
        locate 15,5
        print "Please remain stationary while the sensor temperature stabilizes.
8020    locate 18,25
        print "Calibrating - Please wait."
        let stime!=timer
8025    k$=inkey$:if k$="B" or k$="b" then return
        if (timer-stime!) <15 then 8025      'start 15 second minimum wait


8027    rem stabilization routines
        locate 18,25
        print "Temperature now stabilizing"

        for i=1 to 100      'get 100 conseq. samples
        gosub 2000    'get input
        let stemp(i)=temp#*g#
        next i
        for dly=1 to 50000:next dly

        locate 18,25
        print "                              "  'toggle the prompt

        k$=inkey$:if k$="B" or k$="b" then return

8030    rem << Average Filter >>
        for j=1 to 100
        let savg=savg+stemp(j)
        next j
        savg=savg/100

        if abs(savg-lastavg) < .720 then return
        lastavg=savg:savg=0

        if (timer-stime) >180 then return

        for dly=1 to 35000:next dly
        yavg#=0   'reset for next try
        goto 8027

9000 rem ** Handle Overlay routine **
9001 c=0
9005 LINE(75,68)-(565,278),12,bf
9010 LOCATE 23,5:PRINT"

9190 LOCATE 15,15:PRINT"<O>VERLAY FILE"
9210 LOCATE 17,15:PRINT"FILE NAME"
9230 LOCATE 19,13:PRINT d$;"___________.DAT"
9340 LOCATE 6,14:PRINT"<M>AIN MENU":locate 6,50:print"<D>irectory"

9400 REM ** Input handler **
9410 LET K$=INKEY$:IF K$="" THEN 9410
9420 IF K$="M" OR K$="m" THEN colr=11:GOTO 7000  ' REDRAW DISPLAY
9430 IF K$="O" OR K$="o" THEN GOTO 9510
     if k$="D" or k$="d" then vect=2:goto 465
9440 goto 9410
```

NDM 196 IA - 30 -

```
9510 LOCATE 19,15,1     ' c   lay  ROUTINE
9520 PRINT "*";            ver
9530 I$=INKEY$:IF I$="" THEN 9530
9540 IF ASC(I$)=13 THEN c=0:goto 9600
9550 IF ASC(I$)=8 THEN GOSUB 6750:goto 9530
9560 IF ASC(I$)=27 THEN 9000
9570 IF ASC(I$)<48 OR ASC(I$)>122 THEN 9530
9580 IF ASC(I$)>57 AND ASC(I$)<64 THEN 9530
9590 IF ASC(I$)>90 AND ASC(I$)<97 THEN 9530
9595 IF C<8 THEN rt$=rt$+I$:PRINT I$;:C=C+1
9597 GOTO 9530

9600 REM **** INPUT FILE FROM DISK *******
9605 ON ERROR GOTO 10700
9610 FILE$=d$+pth$+RT$+".DAT":RT$=""
9620 OPEN "I",#1,FILE$
9630 FOR SAMPLE =1 TO 1440
9640 INPUT #1,overlay(SAMPLE)
9650 NEXT SAMPLE
     'input #1,nothing$,nothing$
9660 CLOSE 1
     colr = 11
9670 ovlflg=1:GOTO 7000  ' DISPLAY NEW DATA

10700 rem ** Error Handler for overlay **
10705 LOCATE 23,5:PRINT "FILE NOT FOUND!"
10720 FOR DLY=1 TO 55000:NEXT DLY
     close 1
10730 RESUME 9000
10740 END

11000 REM DISPLAY SETUP
        LOCATE 1,33:PRINT CHR$(3) CHR$(3)  " CVI DISPLAY "  CHR$(3) CHR$(3)
        LINE (28,48)-(590,298),15,B                          'white border
        LINE (74,67)-(566,279),15,B
        LOCATE 21,8:PRINT USING G$;0: LOCATE 21,29:PRINT USING G$;10
        locate 21,18:print using g$;5
        LOCATE 21,50:PRINT USING G$;30 : LOCATE 21,69:PRINT USING G$;50
        locate 21,39:print using g$;20 : locate 21,59:print using g$;40
        LOCATE 5,5:PRINT"1.00" : LOCATE 8,5:PRINT"0.80"
        LOCATE 11,5:PRINT"0.60": LOCATE 14,5:PRINT"0.40"
        LOCATE 17,5:PRINT"0.20": LOCATE 20,5:PRINT "0.00"
        LOCATE 2,28:PRINT" <LR Rheography vs Seconds> "
return

11100 REM display area - blanking
        LINE (75,68)-(565,278),0,BF
        FOR I=0 TO 8:LINE(I*490/12+238.334,68)-(I*490/12+238.334,278),11:NEXT I
        for i=0 to 10:line(i*163/10+75,68)-(i*163/10+75,278),11:next i '10 secon
        FOR I=0 TO 10:LINE(75,I*210/10+68)-(565,I*210/10+68),11:NEXT I     'grid
        LINE (75,173)-(565,173),12                           'center black line
        LOCATE 1,33:PRINT CHR$(3) CHR$(3)
        LOCATE 1,48:PRINT CHR$(3) CHR$(3)
return
```

What is claimed is:

1. A medical device for applying compressive pressure against a patients foot comprising:

first and second panels of flexible material secured to one another to form an inflatable bag to be fitted upon the foot, said bag having first and second separate fluid bladders, said first fluid bladder being adapted to engage a first portion of the foot and said second fluid bladder being adapted to engage a second portion of the foot;

a fluid supply for applying pressurized fluid to said first and second fluid bladders such that said first fluid bladder applies a first compressive pressure upon the first portion of the foot and said second fluid bladder applies a second compressive pressure upon the second portion of the foot, said fluid supply including a generator for cyclically generating fluid pulses during periodic inflation cycles, and a fluid conductor connected to said first and second bladders and said generator for communicating said fluid pulses generated by said generator to said first and second bladders; and, a safety vent port formed through a wall of said fluid conductor, said vent port being constructed to always vent pressurized fluid continuously to atmosphere.

2. A medical device as set forth in claim 1, wherein said fluid conductor comprises a first tubular line connected at its distal end to said first bladder, a second tubular line connected at its distal end to said second bladder, a Y-connector connected at its first distal end to a proximal end of said first tubular line and at its second distal end to a proximal end of said second tubular line, and a third tubular line connected at its distal end to a proximal end of said Y-connector, said Y-connector including said vent port.

3. A medical device as set forth in claim 2, wherein said Y-connector further including a restrictive orifice for preventing delivery of fluid into said second bladder at the same rate at which fluid is delivered into said first bladder.

4. A medical device as set forth in claim 1, wherein said fluid conductor comprises a first tubular line connected at its distal end to said first bladder, a second tubular line connected at its distal end to said second bladder, a Y-connector connected at its first distal end to a proximal end of said first tubular line and at its second distal end to a proximal end of said second tubular line, and a third tubular line connected at its distal end to a proximal end of said Y-connector, said second tubular line including said vent port.

5. A medical device as set forth in claim 4, wherein said Y-connector further including a restrictive orifice for preventing delivery of fluid into said second bladder at the same rate at which fluid is delivered into said first bladder.

6. An inflatable bag adapted to be secured to a patient's foot for applying compressive pressures against the patient's foot upon receiving pressurized fluid from a fluid source, said bag comprising:

first and second panels of flexible material secured to one another to form first and second separate fluid bladders, said first fluid bladder being adapted to engage a first portion of the foot for applying a first compressive pressure thereto and said second fluid bladder being adapted to engage a second portion of the foot for applying a second compressive pressure thereto;

a fluid conductor connected to said first and second bladders and the fluid source to permit said fluid source to supply pressurized fluid to said first and second bladders; and, a safety vent port formed through a wall of said fluid conductor, said vent port being constructed to always vent pressurized fluid continuously to atmosphere.

7. A medical device as set forth in claim 6, wherein said fluid conductor comprises a first tubular line connected at its distal end to said first bladder, a second tubular line connected at its distal end to said second bladder, a Y-connector connected at its first distal end to a proximal end of said first tubular line and at its second distal end to a proximal end of said second tubular line, and a third tubular line connected at its distal end to a proximal end of said Y-connector, said Y-connector including said vent port.

8. A medical device as set forth in claim 7, wherein said Y-connector further including a restrictive orifice for preventing delivery of fluid into said second bladder at the same rate at which fluid is delivered into said first bladder.

9. A medical device as set forth in claim 6, wherein said fluid conductor comprises a first tubular line connected at its distal end to said first bladder, a second tubular line connected at its distal end to said second bladder, a Y-connector connected at its first distal end to a proximal end of said first tubular line and at its second distal end to a proximal end of said second tubular line, and a third tubular line connected at its distal end to a proximal end of said Y-connector, said second tubular line including said vent port.

10. A medical device as set forth in claim 9, wherein said Y-connector further including a restrictive orifice for preventing delivery of fluid into said second bladder at the same rate at which fluid is delivered into said first bladder.

11. A medical device for applying compressive pressures against a patient's foot comprising:

first and second panels of flexible material secured to one another to form an inflatable bag to be fitted upon the foot, said bag having first and second separate fluid bladders, said first fluid bladder being adapted to engage a first portion of the foot and said second fluid bladder being adapted to engage a second portion of the foot;

a fluid supply for applying pressurized fluid to said first and second fluid bladders such that said first fluid bladder applies a first compressive pressure upon the first portion of the foot and said second fluid bladder applies a second compressive pressure upon the second portion of the foot, said fluid supply including a generator for cyclically generating fluid pulses during periodic inflation cycles, and a fluid conductor connected to said first and second bladders and said generator for communicating said fluid pulses generated by said generator to said first and second bladders, said fluid conductor having a wall; and, a safety vent port in the form of a hole formed through a portion of the wall of said fluid conductor, said vent port being constructed to continuously vent pressurized fluid to atmosphere.

12. A medical device as set forth in claim 11, wherein said fluid conductor comprises a first tubular line connected at its distal end to said first bladder, a second tubular line connected at its distal end to said second bladder, a Y-connector connected at its first distal end to a proximal end of said first tubular line and at its second distal end to a proximal end of said second tubular line, and a third tubular line connected at its distal end to a proximal end of said Y-connector, and said vent port is a hole formed through a wall of said Y-connector.

* * * * *